US010855025B2

(12) United States Patent
Holub et al.

(10) Patent No.: US 10,855,025 B2
(45) Date of Patent: Dec. 1, 2020

(54) CONNECTOR POSITION ASSURANCE DEVICE, CONNECTOR SYSTEM AND METHOD FOR OPERATING THE CONNECTOR SYSTEM

(71) Applicant: J.S.T. CORPORATION, Farmington Hills, MI (US)

(72) Inventors: Franklin A. Holub, West Bloomfield, MI (US); Jong Soo Kim, Farmington Hills, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 0 days.

(21) Appl. No.: 15/957,284

(22) Filed: Apr. 19, 2018

(65) Prior Publication Data

US 2018/0316132 A1 Nov. 1, 2018

Related U.S. Application Data

(60) Provisional application No. 62/492,423, filed on May 1, 2017.

(51) Int. Cl.
*H01R 13/627* (2006.01)
*H01R 13/436* (2006.01)
(Continued)

(52) U.S. Cl.
CPC ..... *H01R 13/6275* (2013.01); *H01R 13/4362* (2013.01); *H01R 13/641* (2013.01); *H01R 43/26* (2013.01); *H01R 13/6272* (2013.01)

(58) Field of Classification Search
CPC ..... H01R 13/639; H01R 13/6275; H01R 13/4362
(Continued)

(56) References Cited

U.S. PATENT DOCUMENTS 5,681,178 A * 10/1997 Kunkle ..... H01R 13/641 439/352
5,830,002 A * 11/1998 Ito ..... H01R 13/6272 439/358
(Continued)

FOREIGN PATENT DOCUMENTS

WO 2016173971 A1 11/2016

OTHER PUBLICATIONS

U.S. Appl. No. 15/957,257 by Franklin A. Holub et al., filed Apr. 19, 2018.
(Continued)

*Primary Examiner* — Peter G Leigh
(74) *Attorney, Agent, or Firm* — Kratz, Quintos & Hanson, LLP

(57) ABSTRACT

A connector position assurance device having multiple features for assuring a full coupling and locking of a female housing with a male housing in a connector system, such that the female housing and male housing are placed into a fully coupled and locked position when the connector position assurance device is moved from a pre-lock position to a full-lock position. When the connector position assurance device is at a full-lock position, a first member on the connector position assurance penetrates a window formed on the female housing, and at least one ledge extending from the connector position assurance device prevents a flexible member of the female housing from being moved downward, providing assurance that the female and male housings are fully coupled and locked together.

14 Claims, 52 Drawing Sheets

(51) Int. Cl.
*H01R 43/26* (2006.01)
*H01R 13/641* (2006.01)

(58) Field of Classification Search
USPC ..... 439/352, 357, 389
See application file for complete search history.

(56) References Cited

U.S. PATENT DOCUMENTS 6,024,595 A * 2/2000 Saba ..... H01R 13/6272 439/352
6,045,388 A * 4/2000 Higgins ..... H01R 13/6273 439/352
6,077,101 A * 6/2000 Garretson ..... H01R 13/627 439/352
6,109,955 A 8/2000 Hanazaki
6,261,115 B1 * 7/2001 Pederson ..... H01R 13/6272 439/352
6,261,116 B1 * 7/2001 Ceru ..... H01R 13/6272 439/352
6,276,953 B1 8/2001 Gauker
6,312,277 B1 * 11/2001 Holub ..... H01R 13/6272 439/352
6,354,860 B1 * 3/2002 Miller ..... H01R 13/6272 439/352
6,406,319 B2 * 6/2002 Pederson ..... H01R 13/6272 439/352
6,435,895 B1 * 8/2002 Fink ..... H01R 13/6272 439/352
6,491,542 B1 12/2002 Zerebilov
6,530,799 B2 * 3/2003 Regnier ..... H01R 13/6273 439/352
6,780,045 B2 * 8/2004 Shuey ..... H01R 13/6272 439/352
6,811,424 B2 11/2004 Seminara
6,866,534 B2 * 3/2005 Hirschmann ..... H01R 13/639 439/188
7,201,599 B2 * 4/2007 Holub ..... H01R 13/506 439/352
7,229,305 B2 * 6/2007 Hirschmann ..... H01R 13/6273 439/352
7,267,569 B2 * 9/2007 Nakamura ..... H01R 13/623 439/353
7,326,074 B1 2/2008 Lim
7,396,253 B2 * 7/2008 Nakamura ..... H01R 13/641 439/188
7,399,195 B2 * 7/2008 Kim ..... H01R 13/641 439/352
7,470,138 B1 * 12/2008 Chen ..... H01R 13/506 439/352
7,544,081 B2 * 6/2009 Lim ..... H01R 13/4361 439/352
7,601,019 B2 * 10/2009 Hsieh ..... H01R 13/426 439/345
7,909,638 B2 * 3/2011 Seo ..... H01R 13/6272 439/352
8,016,606 B1 9/2011 Kwan
8,137,142 B1 * 3/2012 Dawson ..... H01R 13/639 439/676
8,376,773 B2 2/2013 Ma
8,616,914 B2 * 12/2013 Mumper ..... H01R 13/6272 439/489
8,678,846 B2 * 3/2014 Hitchcock ..... H01R 13/6272 439/352
8,747,146 B2 * 6/2014 Brown ..... H01R 13/641 439/489
8,801,453 B1 * 8/2014 Scorzelli ..... H01R 13/639 439/352
8,926,355 B2 * 1/2015 Heil ..... H01R 13/641 439/352
9,054,458 B1 * 6/2015 Ng ..... H01R 13/641
9,071,015 B1 * 6/2015 Tan ..... H01R 13/6272
9,160,095 B2 * 10/2015 Littek ..... H01R 13/422
9,300,084 B2 * 3/2016 Wimmer ..... H01R 13/639
9,425,534 B2 * 8/2016 Schmidt ..... H01R 13/6272
9,478,906 B2 * 10/2016 Myer ..... H01R 13/6273
9,680,256 B1 * 6/2017 Lane ..... H01R 13/6275
9,876,312 B1 * 1/2018 Li ..... H01R 13/6275
9,893,467 B2 2/2018 Chen
9,935,399 B2 * 4/2018 Sekino ..... H01R 13/641
10,038,278 B2 7/2018 Lane
2002/0052135 A1 * 5/2002 Noguchi ..... H01R 13/4367 439/352
2002/0064997 A1 * 5/2002 Noguchi ..... H01R 13/641 439/607.01
2003/0162444 A1 * 8/2003 Hayashi ..... H01R 13/719 439/620.05
2004/0248453 A1 12/2004 McLauchlan et al.
2005/0221652 A1 * 10/2005 Volpone ..... H01R 13/6272 439/329
2007/0161284 A1 * 7/2007 Tyler ..... H01R 13/6272 439/489
2008/0248668 A1 * 10/2008 Ripper ..... H01R 13/68 439/188
2009/0023325 A1 1/2009 Chen
2009/0298320 A1 * 12/2009 Schmitt ..... H01R 13/6275 439/352
2010/0233897 A1 * 9/2010 Seo ..... H01R 13/6272 439/345
2011/0045683 A1 * 2/2011 Foung ..... H01R 13/6272 439/352
2012/0282791 A1 * 11/2012 Brown ..... H01R 13/639 439/157
2013/0237083 A1 * 9/2013 Kon ..... H01R 13/6272 439/354
2013/0260590 A1 * 10/2013 Hitchcock ..... H01R 13/6272 439/312
2013/0337677 A1 * 12/2013 Puckett ..... H01R 13/641 439/357
2014/0134867 A1 * 5/2014 Kon ..... H01R 13/627 439/345
2014/0302702 A1 10/2014 Germ
2015/0031228 A1 * 1/2015 Oh ..... H01R 13/641 439/347
2015/0147901 A1 * 5/2015 Wu ..... H01R 13/639 439/357
2015/0222055 A1 * 8/2015 Plazio ..... H01R 13/639 439/347
2016/0118741 A1 * 4/2016 Schmidt ..... H01R 13/6272 439/131
2016/0204551 A1 * 7/2016 Kanda ..... H01R 13/639 439/372
2017/0040741 A1 * 2/2017 Droesbeke ..... H01R 13/506
2017/0062982 A1 * 3/2017 Holub ..... H01R 13/6271
2017/0062983 A1 * 3/2017 Holub ..... H01R 13/639
2017/0063003 A1 3/2017 Spencer
2017/0077646 A1 * 3/2017 Kim ..... H01R 13/6272
2017/0170601 A1 6/2017 Chen
2017/0250501 A1 * 8/2017 Endo ..... H01R 13/6271
2018/0062314 A1 * 3/2018 Schmidt ..... H01R 13/639

OTHER PUBLICATIONS

International Search Report in PCT/US2018/029822, dated Jul. 2, 2018.
Written Opinion in PCT/US2018/029822, dated Jul. 2, 2018.
International Search Report in PCT/US2018/029813, dated Jul. 6, 2018.
Written Opinion in PCT/US2018/029813, dated Jul. 6, 2018.
Office Action of U.S. Appl. No. 15/957,257 dated Oct. 3, 2018 (Office Action 9 pages, Notice of References Cited 1 page, 10 pages total).

* cited by examiner

CONNECTOR POSITION ASSURANCE DEVICE, CONNECTOR SYSTEM AND METHOD FOR OPERATING THE CONNECTOR SYSTEM

CROSS-REFERENCE TO RELATED APPLICATIONS

This patent application claims priority to U.S. Provisional Patent Application No. 62/492,423 filed May 1, 2017, which is hereby incorporated herein by reference in its entirety.

BACKGROUND OF THE INVENTION

The present invention generally relates to a connector system having a connector position assurance device for assuring the engagement of a male housing with a female housing. The connector system includes the connector position assurance device, the male housing and the female housing. The female housing receives the connector position assurance device to assure the male and female housings are engaged with each other. The female housing can receive an optional terminal position assurance device, regarding connections of at least one terminal for one or more electrical wires and/or electrical connections. The male housing can receive an optional terminal position assurance device, regarding connections of at least one terminal for one or more electrical wires and/or electrical connections.

SUMMARY OF THE INVENTION

A connector position assurance (CPA) device is inserted into a female housing before the female housing is coupled with a male housing, such that the CPA device is at a pre-lock position. The CPA device serves to assure the engagement of the male housing with the female housing. If the male housing and female housing are engaged together, the engagement thereof is assured when the CPA device is placed at the full-lock position.

If an optional terminal position assurance (TPA) device is being used for the female housing, the TPA device can be inserted into the female housing before the female housing is coupled with the male housing, such that the TPA device is at a pre-lock position. When the TPA device is in the pre-lock position, it is not possible to easily insert the female housing into the male housing, because the TPA device extends out from the body of the female housing to cause an outer dimension of the female housing/TPA device combination to be too large to fit into the male housing. When the female housing is to be inserted into the male housing, the TPA device must be inserted further into the female housing, such that the TPA device is at a full-lock position. When the TPA device is at the full-lock position, the female housing can be inserted all the way into the male housing.

When the female housing is inserted all the way into the male housing, the CPA device can be inserted further into the female housing, such that the CPA device is at a full-lock position.

At least one terminal, for one or more electrical wires and/or electrical connections, is provided into the female housing when the TPA device is at a pre-lock position. The at least one terminal provided into the female housing is secured thereto when the TPA device is moved to the full-lock position.

With the TPA device being at the full-lock position, the female housing can enter the inside of the male housing, and both the male and female housings can be fully engaged together with the CPA device. The full engagement of the male housing with the female housing is assured when the CPA device is at a full-lock position.

Additional features, advantages, and embodiments of the invention are set forth or apparent from consideration of the following detailed description, drawings and claims. Moreover, it is to be understood that both the foregoing summary of the invention and the following detailed description are exemplary and intended to provide further explanations without limiting the scope of the invention as claimed.

DETAILED DESCRIPTION OF THE PREFERRED EMBODIMENTS

Figure 1:
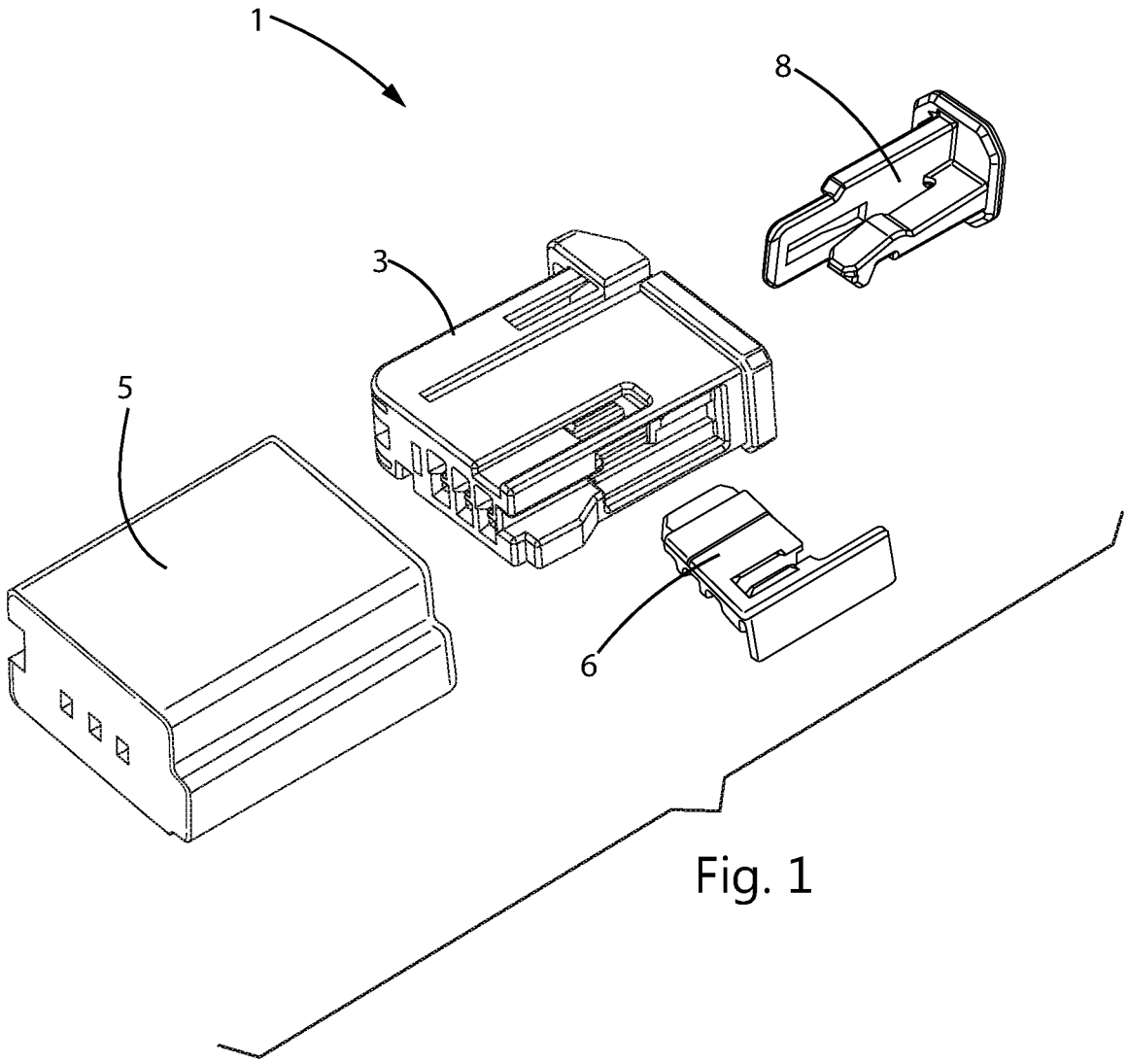
FIG. 1 is an exploded perspective view of the connector system of the present invention, showing a male housing, a female housing, a connector position assurance (CPA) device, and an optional terminal position assurance (TPA) device, illustrating a first embodiment of the present invention.

FIG. 1 is an exploded perspective view of the connector system of the present invention, showing a male housing, a female housing, a connector position assurance (CPA) device, and an optional terminal position assurance (TPA) device, illustrating a first embodiment of the present invention.

The first embodiment, shown in FIG. 1, illustrates a three-pin configuration wherein a male housing and a female housing have apertures and features accommodating three pins or three terminals for electrical wires and/or electrical connections.

As shown in FIG. 1, the connector system is generally referred to by reference number 1, and includes a female housing 3, a male housing 5, a connector position assurance (CPA) device 8, and an optional terminal position assurance (TPA) device 6.

Figure 2A:
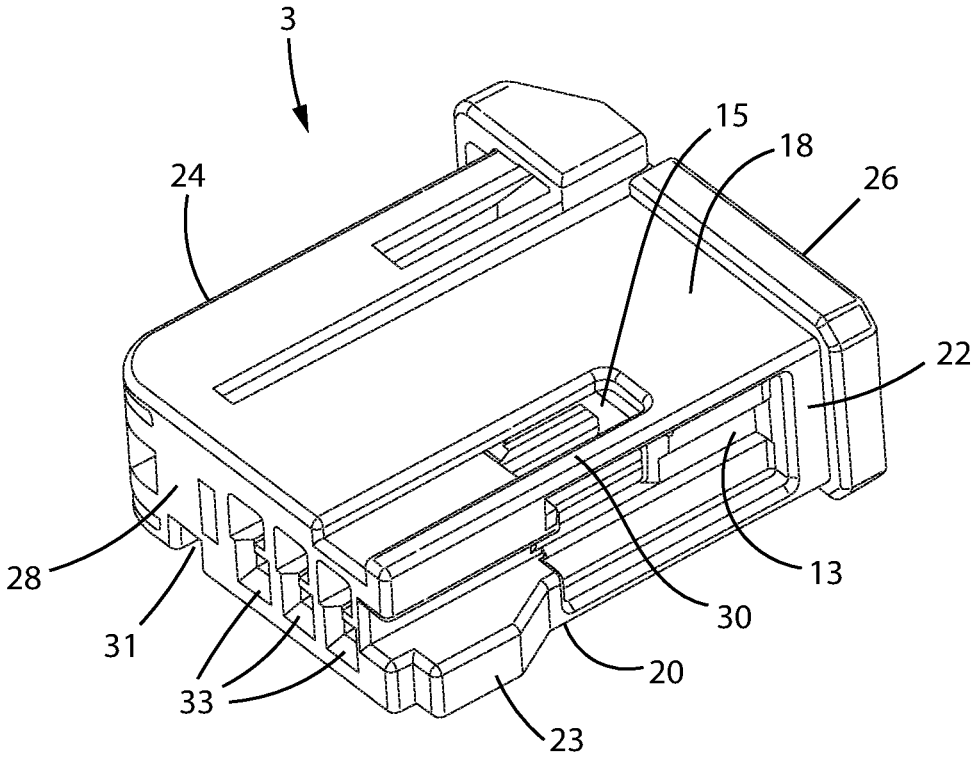
FIG. 2A is a first perspective view of the female housing of FIG. 1.
Figure 2B:
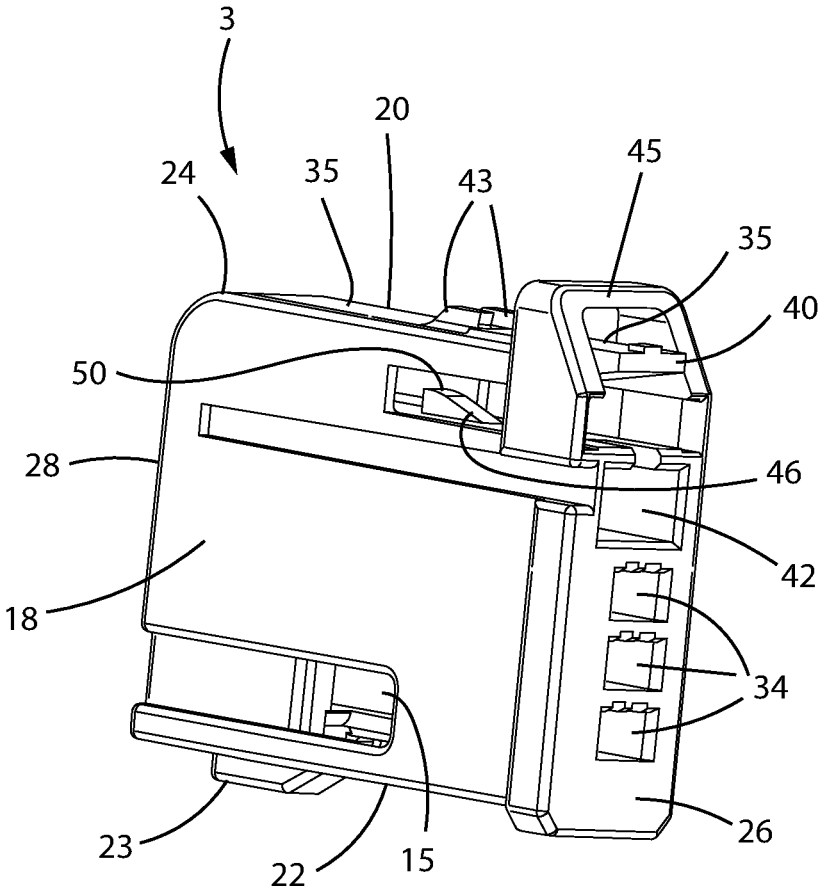
FIG. 2B is a second perspective view of the female housing of FIG. 1.
Figure 2C:
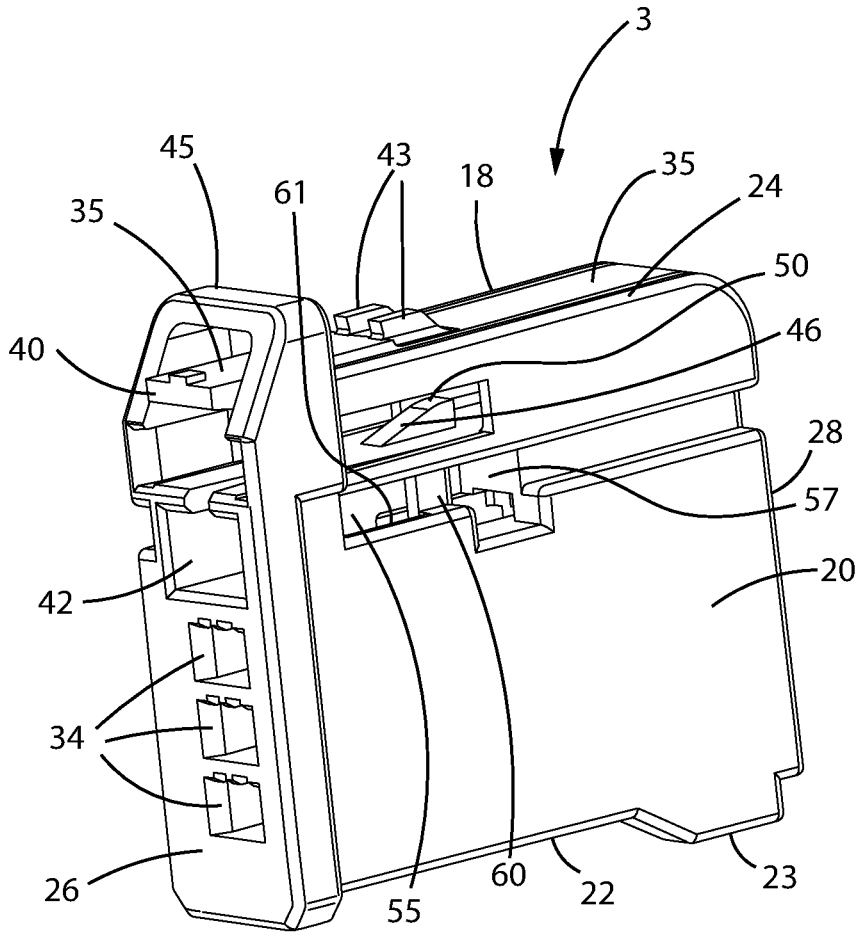
FIG. 2C is a third perspective view of the female housing of FIG. 1.

FIG. 2A is a first perspective view of the female housing of FIG. 1. FIG. 2B is a second perspective view of the female housing of FIG. 1. FIG. 2C is a third perspective view of the female housing of FIG. 1.

The female housing 3 has an upper side 18, a lower side 20, a first side 22, a second side 24, a front end side 26, and a back end side 28. A side slot 13 is located on the first side 22 of the female housing 3. A top slot 15 is located on the upper side 18 of the female housing 3. A protrusion 23 is located on the first side 22 of the female housing 3. An exterior bridge member 30 is located at a position adjacent to the top slot 15. A groove 31 is located on a lower side 20 of the female housing 3. Three terminal slots 33 are located on the back end side 28.

Three terminal slots 34 are located on the front end side 26. A flexible member 35 or flexible arm 35 is located on the female housing, as shown in FIG. 2B. The flexible member 35 has a front end 40. Two protruding members 43 are formed on the flexible member 35. The front side 26 of the female housing 3 forms an opening 42. A substantially U-shaped member 45 is on the female housing 3. In the female housing 3, there is a ramp-like member 46 which has an end portion 50.

A first window 55 and a second window 57 are formed in the lower side 20 of the female housing 3, as shown in FIG. 2C. An interior bridge member 60 is located in the female housing 3, as shown in FIG. 2C. The first window 55 is adjacent to the interior bridge member 60. The second window 57 is also adjacent to the interior bridge member 60. The interior bridge member 60 is disposed between the first window 55 and the second window 57.

As explained later, the side slot 13 receives the optional TPA device 6. The exterior bridge member 30 is located between the side slot 13 and the top slot 15.

FIG. 2B shows the flexible member 35 extending along the second side 24 of the female housing 3, such that the front end 40 of the flexible member 35 extends to a position near the substantially U-shaped member 45. The protruding members 43 extend from the flexible member 35 at an intermediate area of the flexible member 35. FIG. 2C shows an engaging member 61 on an interior of the female housing 3.

Figure 3A:
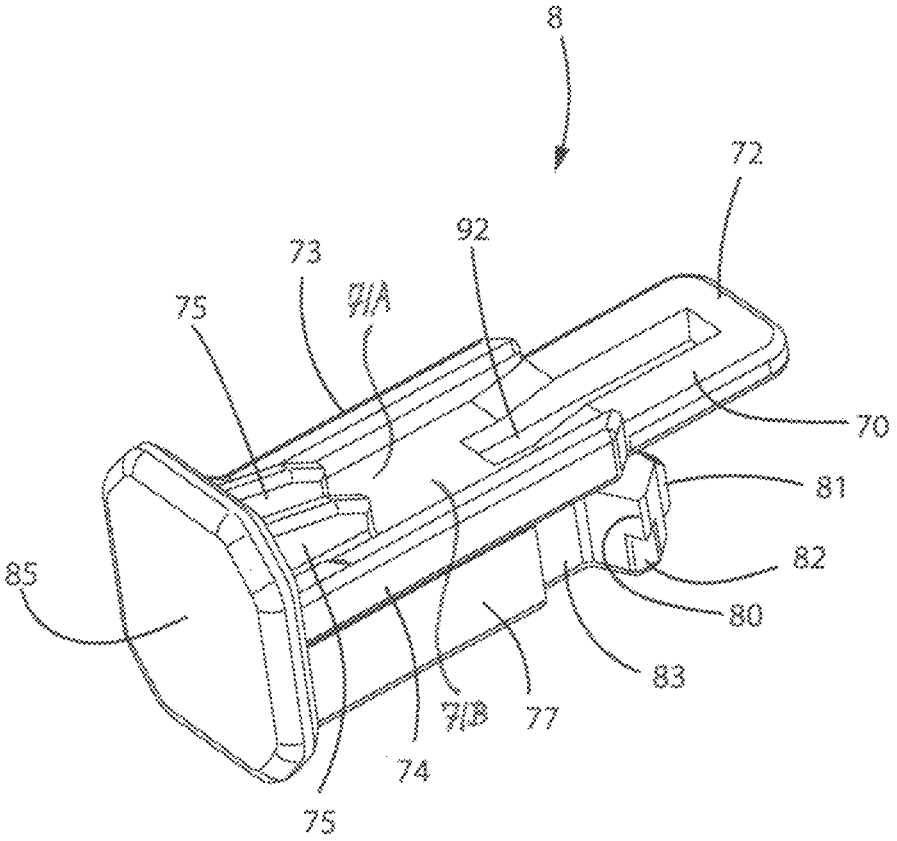
FIG. 3A is a first perspective view of the CPA device of FIG. 1.
Figure 3B:
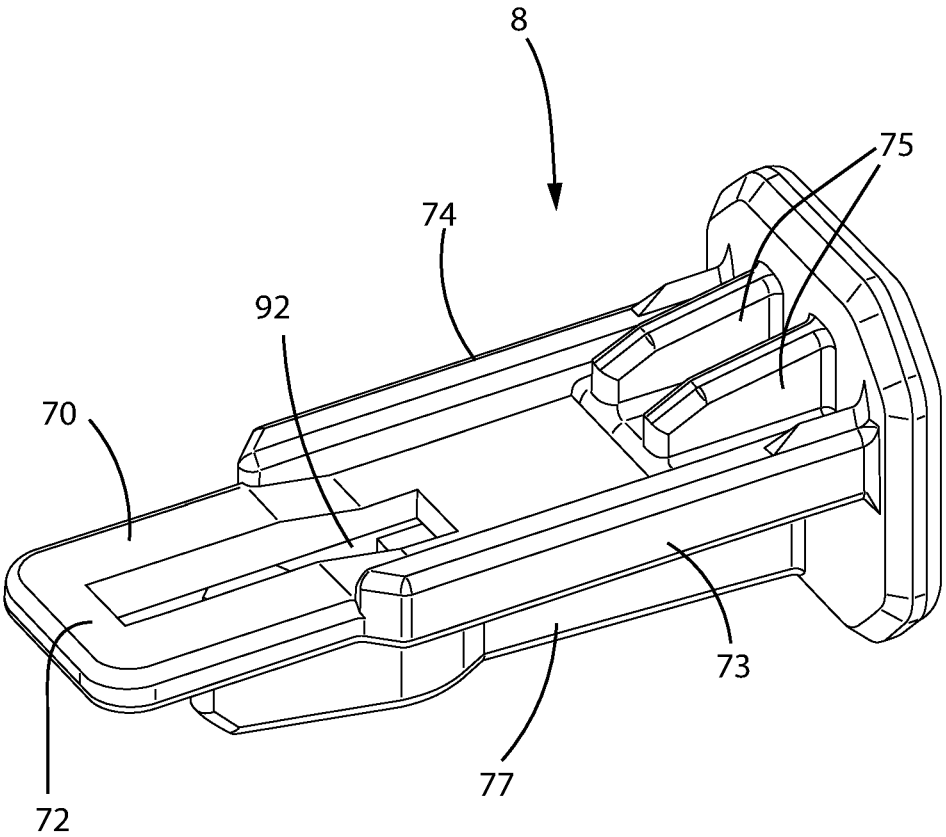
FIG. 3B is a second perspective view of the CPA device of FIG. 1.
Figure 3C:
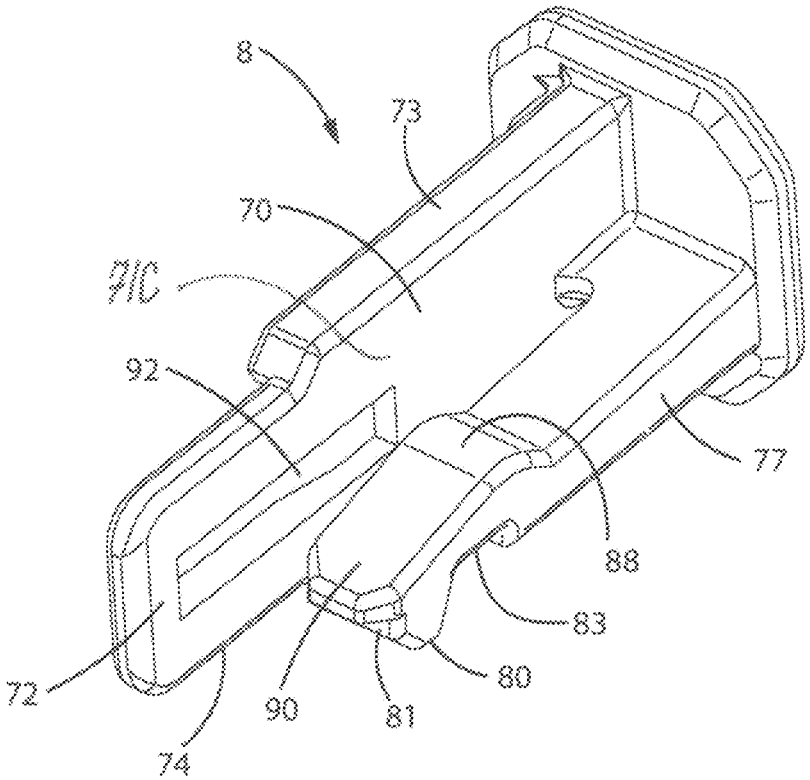
FIG. 3C is a third perspective view of the CPA device of FIG. 1.
Figure 3D:
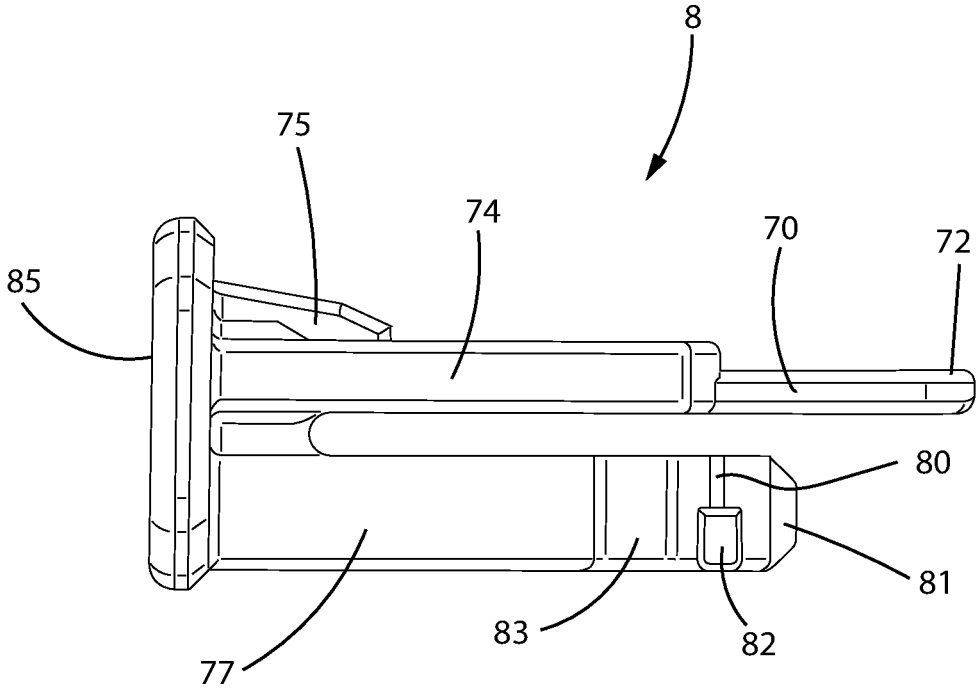
FIG. 3D is an elevational view of the CPA device of FIG. 1.

FIG. 3A is a first perspective view of the CPA device of FIG. 1. FIG. 3B is a second perspective view of the CPA device of FIG. 1. FIG. 3C is a third perspective view of the CPA device of FIG. 1. FIG. 3D is an elevational view of the CPA device of FIG. 1.

FIG. 3A illustrates the CPA device 8 shown in FIG. 1. The CPA device 8 has an upper side 73, lower side 74, side ledges 75, a first flexible side member 70, a second flexible side member 77, and an end portion 85. The first flexible side member 70 has a side end portion 72 and an opening 92. The first flexible side member 70 has a first side 71B. The first side 71B has a first surface 71A.

As shown in FIG. 3A, the second flexible side member 77 has a lower side with a front ledge 81, a wedge-like member 80, a cut-out portion 82 next to the wedge-like member 80, and a back ledge 83. As shown in FIG. 3C, the second flexible side member 77 has an upper side with a ramp-like member 88 and end portion 90. The first flexible side member 70 has a second side 71C.

The CPA device 8 locks the female housing 3 and the male housing 5 together. The ramp-like member 88 provides a spring-like action or a resilience property for the second flexible side member 77, as will be later discussed. The opening 92 passes through an inner portion of the first flexible side member 70.

The back ledge 83, in combination with the wedge-like member 80, forms a substantially U-shaped portion on the lower side of the second flexible side member 77.

As shown in FIG. 3D, the side end portion 72 of the first flexible side member 70 is able to flex in a first direction upward away from the second flexible side member 77 and in a second direction opposite to the first direction. As shown in FIG. 3C, the wedge-like member 80 of the second flexible side member 77 is able to flex in a third direction toward the upper side 73 and in a fourth direction opposite to the third direction.

Figure 4:
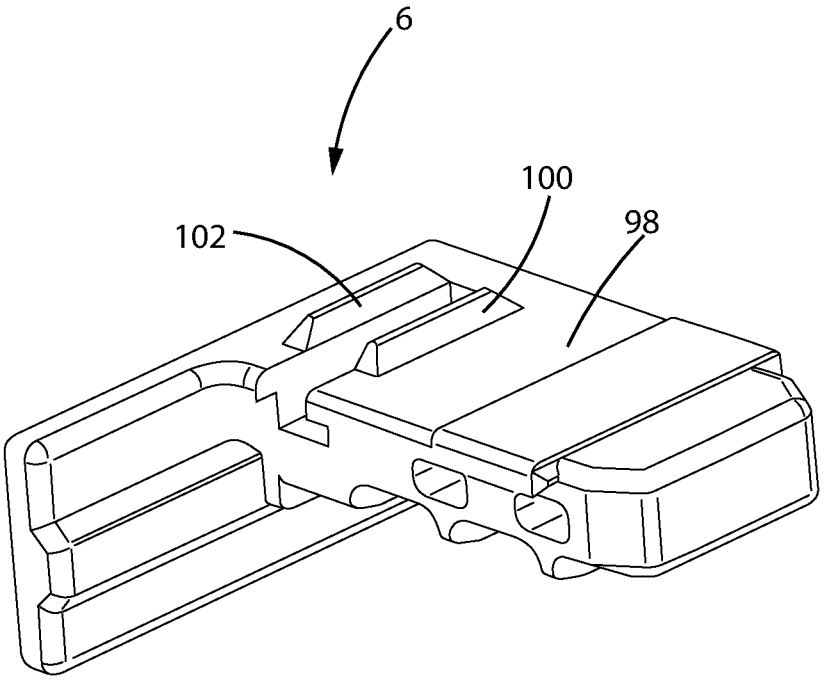
FIG. 4 is a perspective view of the TPA device of FIG. 1.

FIG. 4 is a perspective view of the TPA device of FIG. 1. As shown in FIG. 4, the TPA device 6 is substantially L-shaped. However, the general shape of the TPA device 6 is not limited to such a configuration. A first elongated member 100 and a second elongated member 102 extend from a top portion 98 of the TPA device 6.

Figure 5A:
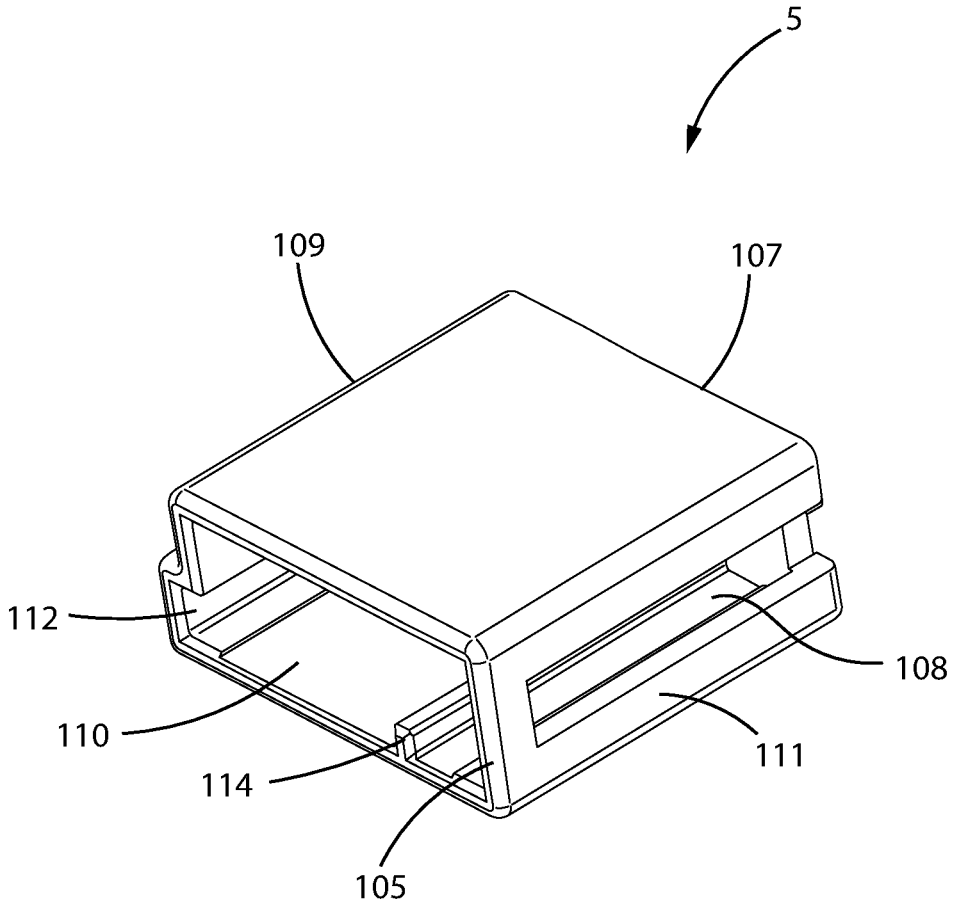
FIG. 5A is a perspective view of the male housing of FIG. 1.
Figure 5B:
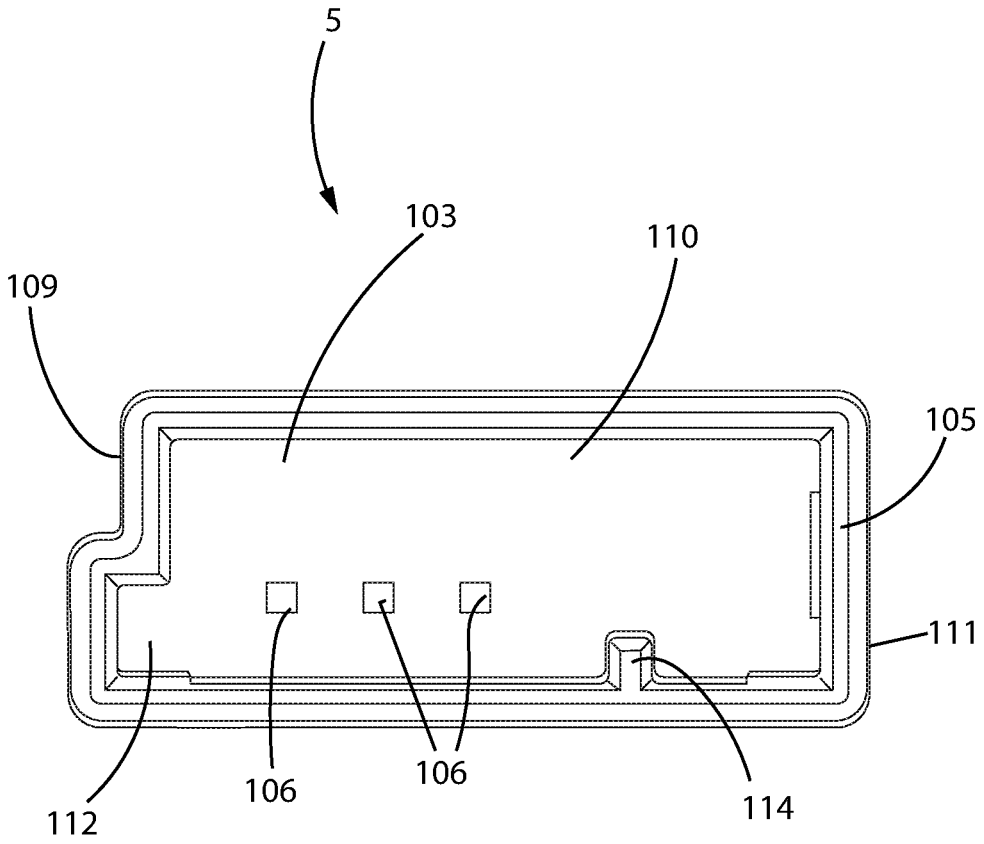
FIG. 5B is an elevational view of the male housing of FIG. 1.

FIG. 5A is a perspective view of the male housing of FIG. 1. FIG. 5B is an elevational view of the male housing of FIG. 1. The male housing 5 is shown in a generic form in FIGS. 1, 5A, and 5B, for example, such that some details of the male housing 5 are not illustrated. The male housing 5 has a first end portion 105, a second end portion 107, a first side 109, a second side 111, an opening 110, a guide groove 112, and a guide protrusion 114. An elongated slot 108 is formed in the second side 111. Also, the male housing 5 has three terminal apertures 106.

As shown in FIG. 5B, the space 103 is the region where the optional TPA device 6 is located, if the TPA device 6 is inserted to a full-lock position in the female housing 3 and then the female housing 3 is inserted into the opening 110 of the male housing 5.

When the female housing 3 is inserted into the opening 110 of the male housing 5, the protrusion 23 is received by the guide groove 112.

Figure 6A:
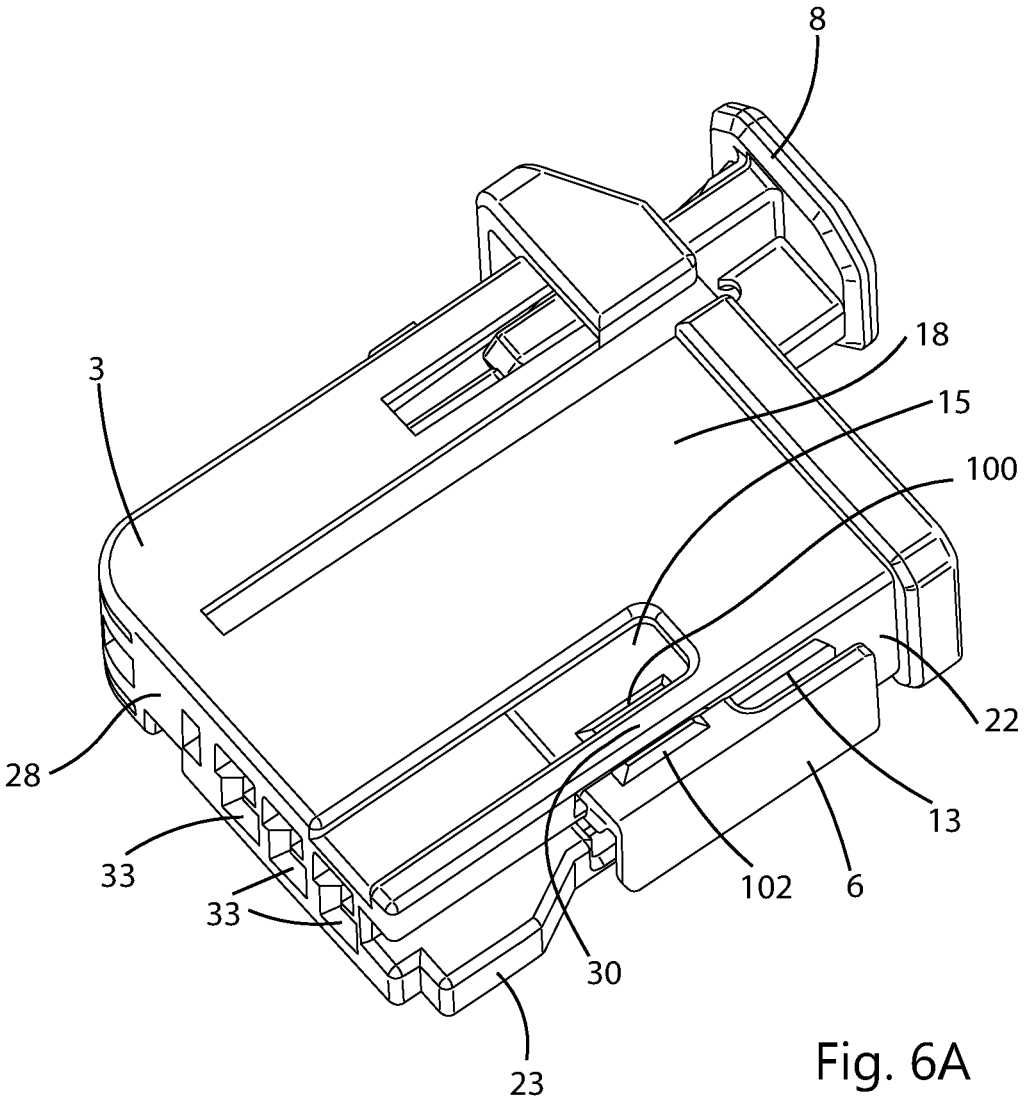
FIG. 6A is a first perspective view of the female housing of FIG. 1, with the TPA device of FIG. 1 at a pre-lock position in the female housing, and with the CPA device of FIG. 1 at a pre-lock position in the female housing.
Figure 6B:
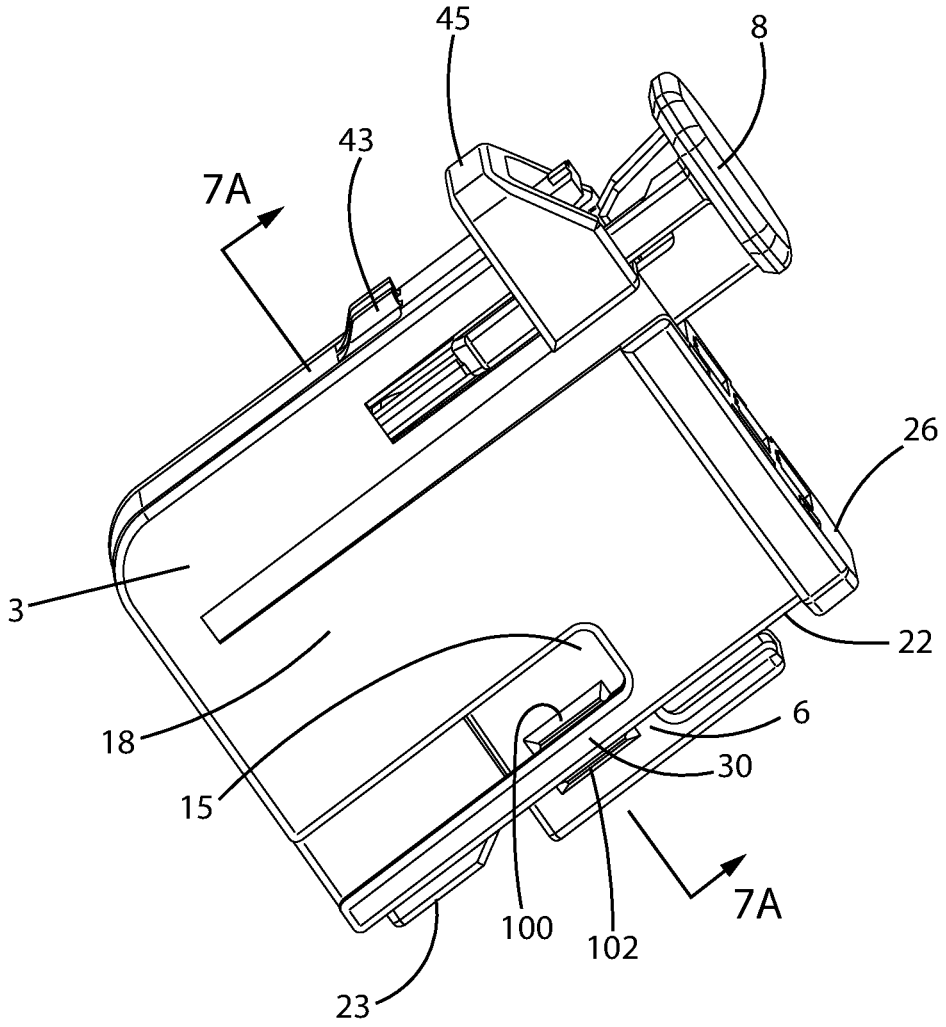
FIG. 6B is a second perspective view of the female housing of FIG. 1, with the TPA device of FIG. 1 at a pre-lock position in the female housing, and with the CPA device of FIG. 1 at a pre-lock position in the female housing.

FIG. 6A is a first perspective view of the female housing of FIG. 1, with the TPA device of FIG. 1 at a pre-lock position in the female housing, and with the CPA device of FIG. 1 at a pre-lock position in the female housing. FIG. 6B is a second perspective view of the female housing of FIG. 1, with the TPA device of FIG. 1 at a pre-lock position in the female housing, and with the CPA device of FIG. 1 at a pre-lock position in the female housing.

As shown in FIG. 6A, the TPA device 6 is inserted into the side slot 13 of the female housing 3 such that the first elongated member 100 passes beneath the exterior bridge member 30 and becomes positioned within the top slot 15 of the female housing 3, the TPA device 6 being in a pre-lock position. As shown in FIGS. 6A and 6B, the CPA device 8 is at a pre-lock position with the female housing 3, while the TPA device 6 is similarly at a pre-lock position.

With the TPA device 6 and CPA device 8 at pre-lock positions, the female housing 3 and the two devices 6, 8 are in a stable configuration and are ready to be transported.

With the CPA device 8 at a pre-lock position inside the female housing 3 (and the TPA device 6 now at a pre-lock position inside the female housing 3), the female housing 3 is ready to be transported to a location where the female housing 3 can be engaged with the male housing 5.

Figure 6C:
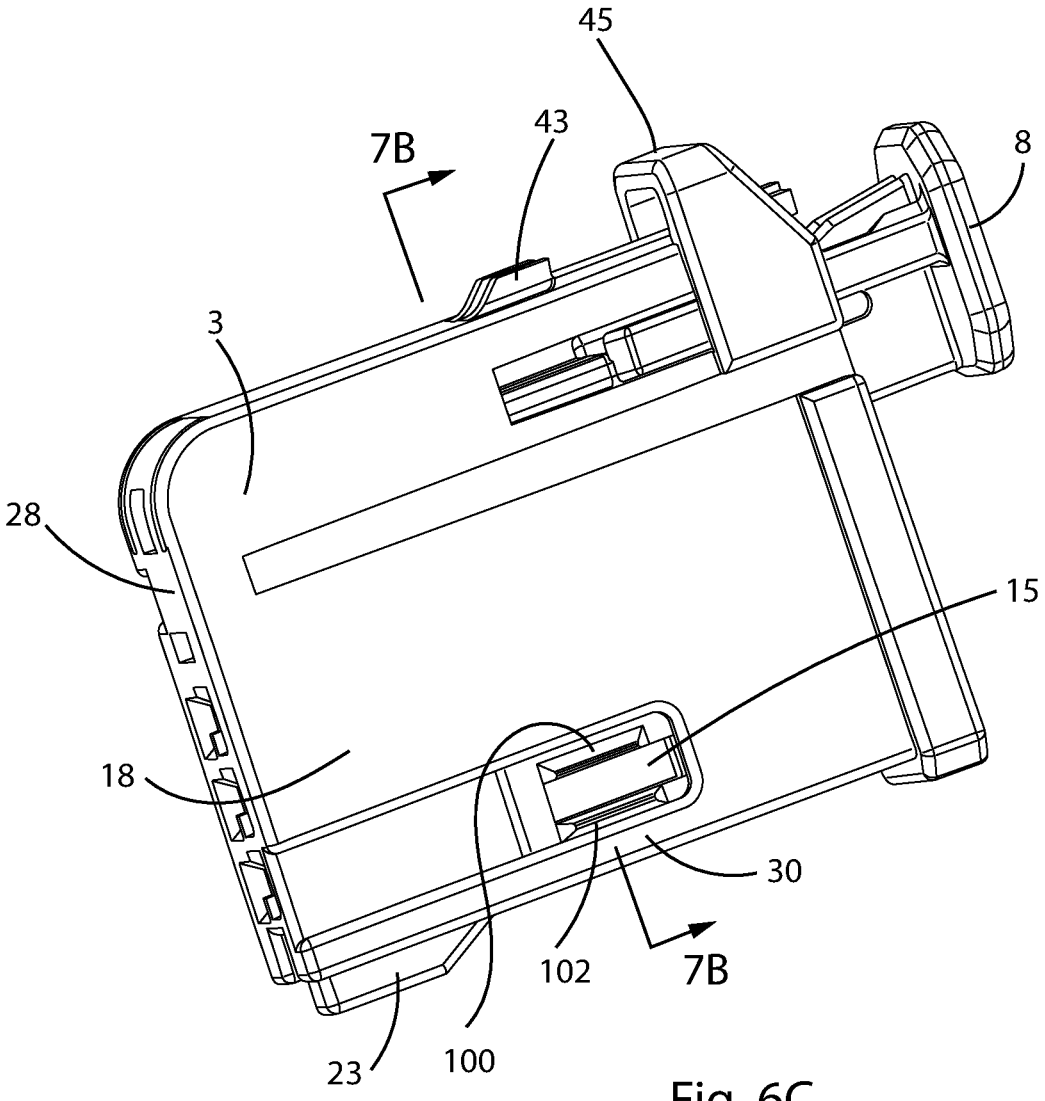
FIG. 6C is a perspective view of the female housing of FIG. 1, with the TPA device of FIG. 1 at a full-lock position in the female housing, and with the CPA device of FIG. 1 at a pre-lock position in the female housing.

FIG. 6C is a perspective view of the female housing of FIG. 1, with the TPA device of FIG. 1 at a full-lock position in the female housing, and with the CPA device of FIG. 1 at a pre-lock position in the female housing. After a set of terminals (not shown) is inserted through the set of terminal slots 33 of the female housing 3, the TPA device 6 is pushed further inward into the side slot 13. At this time, the second elongated member 102 of the TPA device 6 is pushed past the exterior bridge member 30 of the female housing 3, and thus the second elongated member 102 arrives into the top slot 15 of the female housing 3. The TPA device 6 is then at a full-lock position, as shown in FIG. 6C.

Figure 7A:
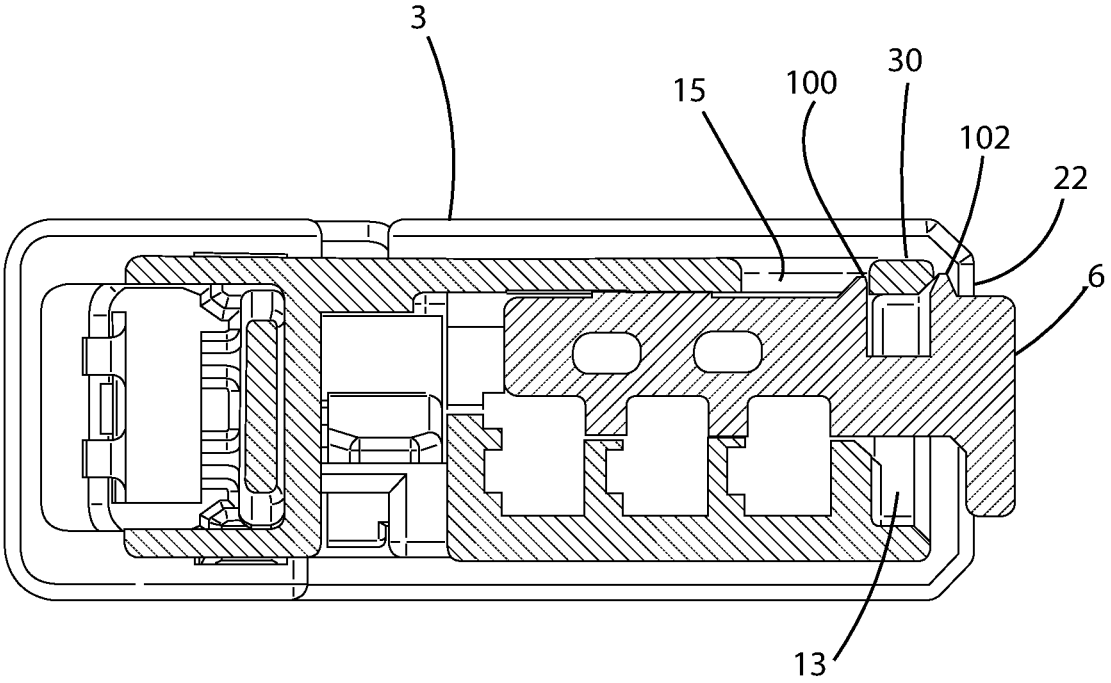
FIG. 7A is a cross-sectional view, taken along line 7A-7A in FIG. 6B, showing the TPA device at a pre-lock position in the female housing.
Figure 7B:
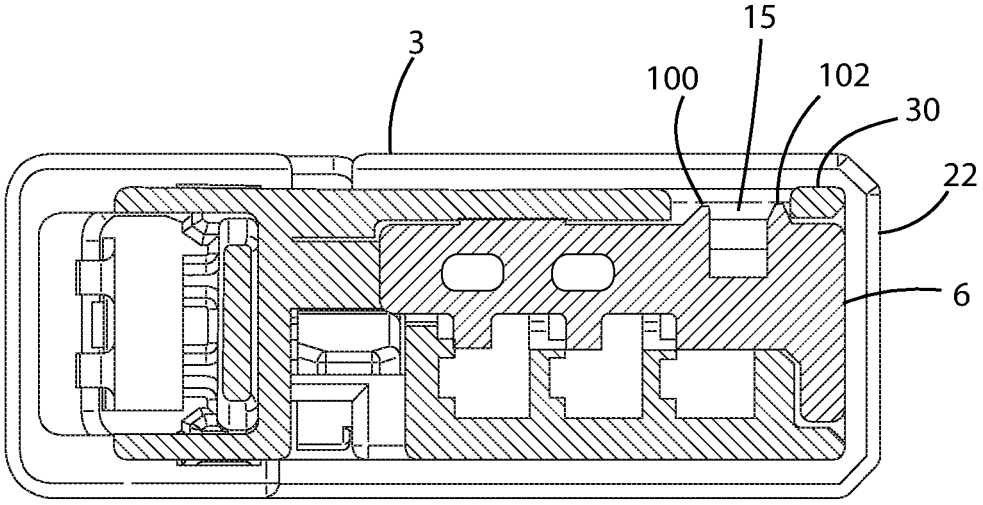
FIG. 7B is a cross-sectional view, taken along line 7B-7B in FIG. 6C, showing the TPA device at a full-lock position in the female housing.

FIG. 7A is a cross-sectional view, taken along line 7A-7A in FIG. 6B, showing the TPA device at a pre-lock position in the female housing. FIG. 7B is a cross-sectional view, taken along line 7B-7B in FIG. 6C, showing the TPA device at a full-lock position in the female housing.

As shown in FIG. 7A, the TPA device 6 is at a pre-lock position, when the first elongated member 100 of the TPA device 6 has been pushed into side slot 13 so that the first elongated member 100 proceeds past the exterior bridge member 30, wherein the first elongated member 100 is located in the top slot 15 and the second elongated member 102 is not in the top slot 15.

As shown in FIG. 7B, the TPA device 6 is at a full-lock position, when the first elongated member 100 and the second elongated member 102 of the TPA device 6 have both been pushed into side slot 13 so that the first elongated member 100 and the second elongated member 102 both proceed past the exterior bridge member 30, wherein the first elongated member 100 and the second elongated member 102 are both located in the top slot 15.

As shown in FIG. 7B, the TPA device 6 is fully inserted into the female housing 3 so that no part of the TPA device 6 extends beyond the exterior edge of the first side 22 of the female housing 3. When the TPA device 6 is at a full-lock position within the female housing 3, the TPA device 6 has secured the set of terminals (not shown) intended to be joined with the female housing 3, and the female housing 3 is ready to be inserted into, and coupled with, the male housing 5. Thus, no part of the TPA device 6 extends beyond the exterior edge of the first side 22 of the female housing 3. When the TPA device 6 is at a full-lock position in the female housing 3, the female housing 3 is able to fully enter, unimpeded, into the opening 110 and guide groove 112 of the male housing 5. After the female housing 3, with the TPA device 6 at a full-lock position therein, has been fully inserted into the male housing 5, the CPA device 8 can be moved from a pre-lock position to a full-lock position by inserting the CPA device 8 further into the female housing 3. After the female housing 3 is inserted into the male housing 5, the movement of the CPA device 8 to a full-lock position provides assurance that the female housing 3 and male housing 5 are fully and properly engaged.

If the female housing 3 is to utilize the optional TPA device 6 (shown in FIG. 4), it is preferable that, first, the female housing 3 have its TPA device 6 at a pre-lock position therein and also have the CPA device 8 at a pre-lock position therein, and then, second, the female housing 3 be transported to an assembly destination with the devices 6 and 8 at pre-lock positions therein during such transport.

If the female housing 3 is not to utilize a TPA device, it is preferable that, first, the female housing 3 initially have the CPA device 8 at a pre-lock position therein, and then, second, the female housing 3 be transported to an assembly destination with the device 8 at a pre-lock position therein during such transport.

If the male housing 5 is to utilize a TPA device (not shown), it is preferable that, first, the male housing 5 have its TPA device at a pre-lock position therein, and then, second, the male housing 5 be transported to an assembly destination with its TPA device at a pre-lock position therein during such transport.

Figure 8A:
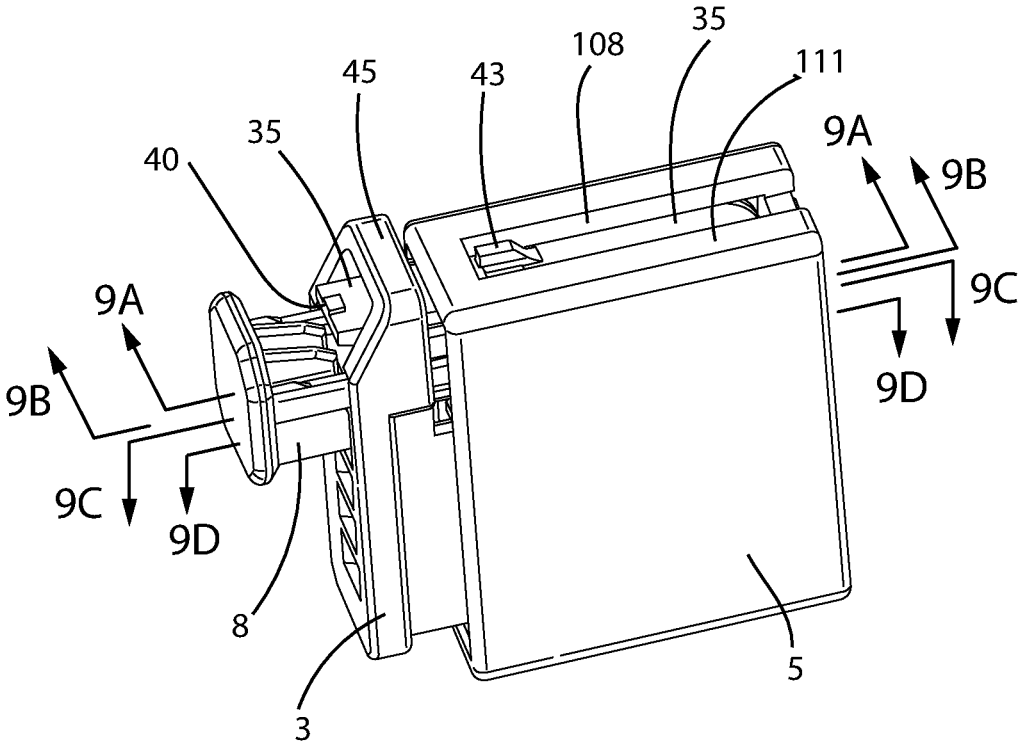
FIG. 8A is a first perspective view of the female housing, male housing, and CPA device shown in FIG. 1, with the female housing coupled with the male housing, and with the CPA device inserted into the female housing at a pre-lock position.
Figure 8B:
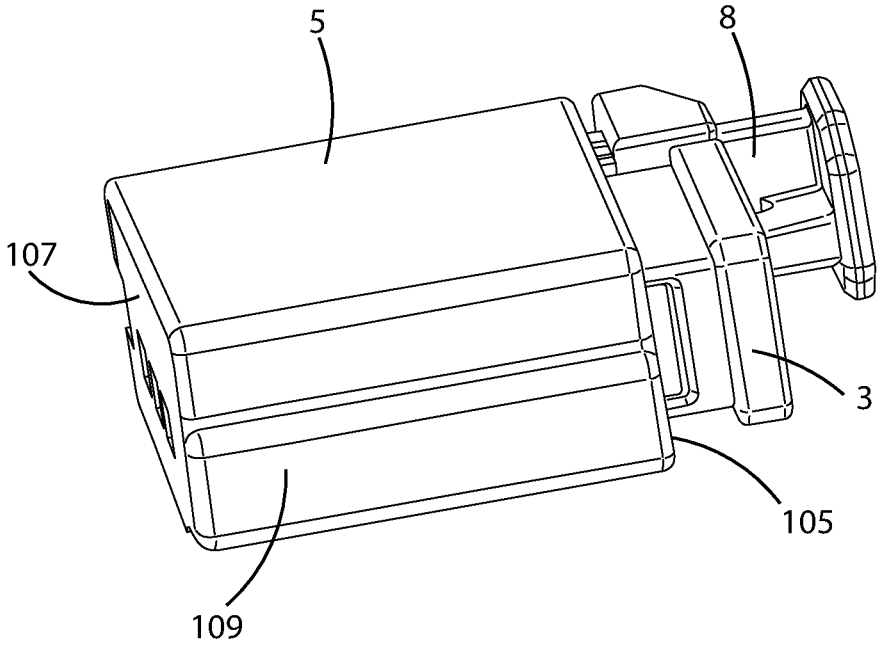
FIG. 8B is a second perspective view of the female housing, male housing, and CPA device shown in FIG. 1, with the female housing coupled with the male housing, and with the CPA device inserted into the female housing at a pre-lock position.

FIG. 8A is a first perspective view of the female housing, male housing, and CPA device shown in FIG. 1, with the female housing coupled with the male housing, and with the CPA device inserted into the female housing at a pre-lock position. FIG. 8B is a second perspective view of the female housing, male housing, and CPA device shown in FIG. 1, with the female housing coupled with the male housing, and with the CPA device inserted into the female housing at a pre-lock position.

Figure 9A:
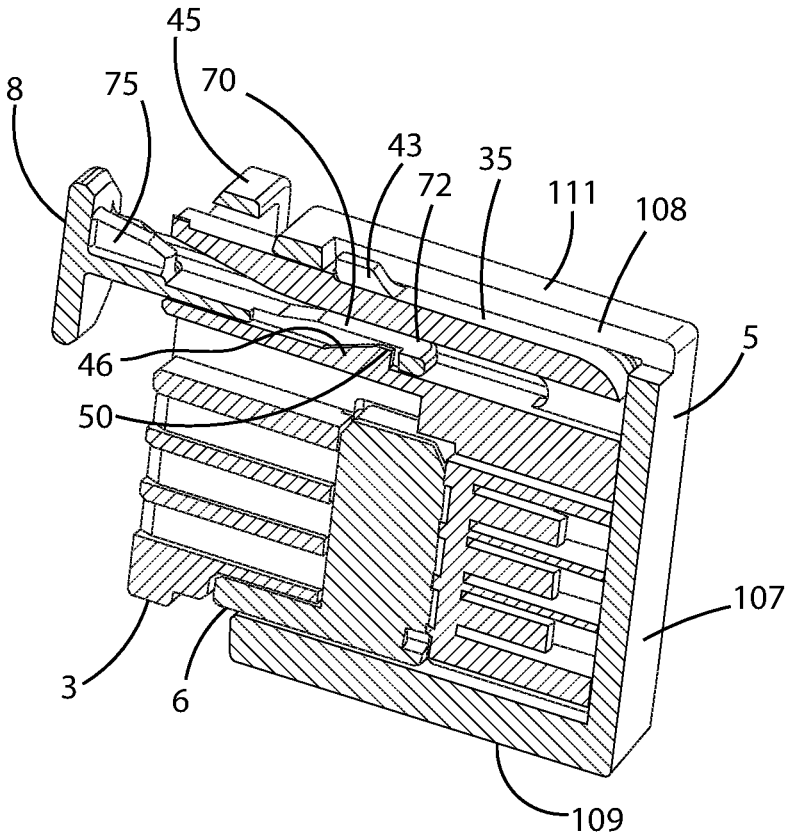
FIG. 9A is a cross-sectional view, taken along line 9A-9A in FIG. 8A.
Figure 9B:
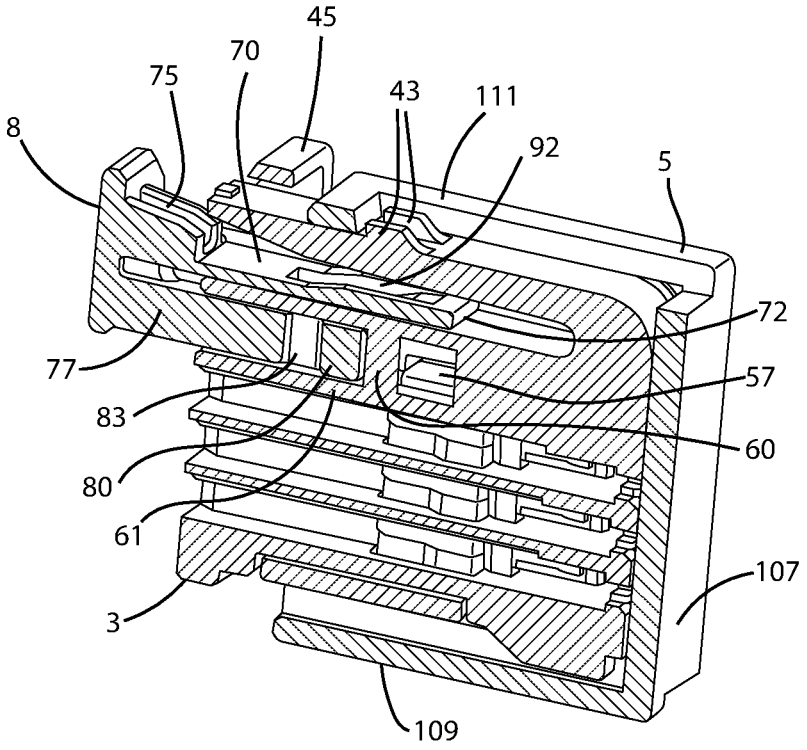
FIG. 9B is a cross-sectional view, taken along line 9B-9B in FIG. 8A.
Figure 9C:
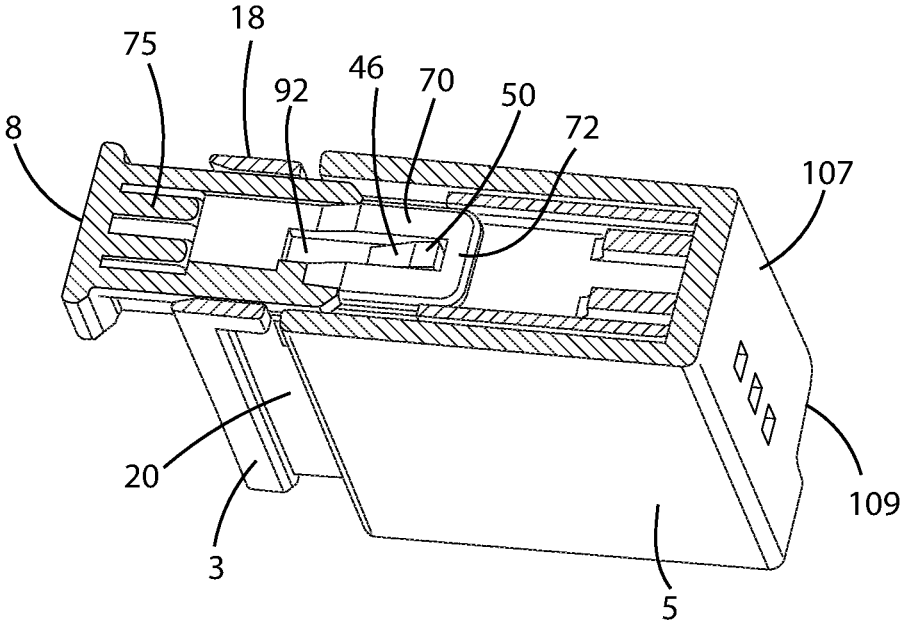
FIG. 9C is a cross-sectional view, taken along line 9C-9C in FIG. 8A.
Figure 9D:
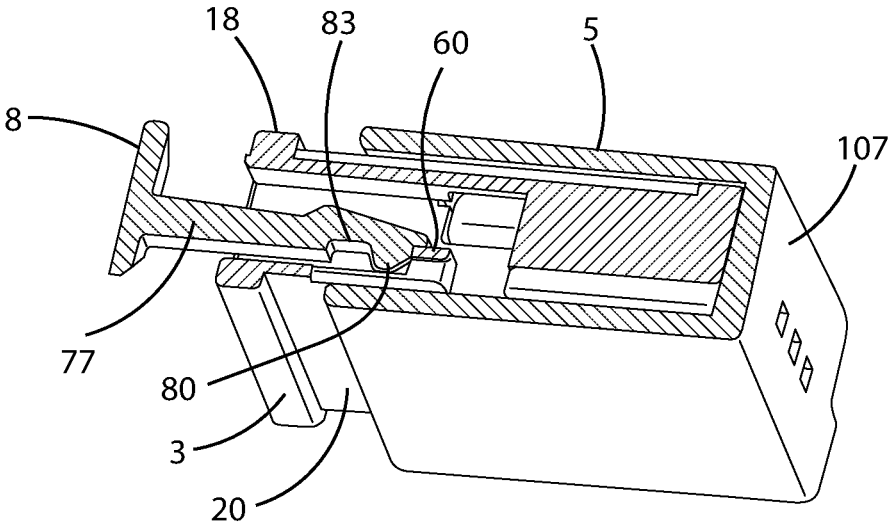
FIG. 9D is a cross-sectional view, taken along line 9D-9D in FIG. 8A.

FIG. 9A is a cross-sectional view, taken along line 9A-9A in FIG. 8A. FIG. 9B is a cross-sectional view, taken along line 9B-9B in FIG. 8A. FIG. 9C is a cross-sectional view, taken along line 9C-9C in FIG. 8A. FIG. 9D is a cross-sectional view, taken along line 9D-9D in FIG. 8A.

FIGS. 8A, 8B, 9A, 9B, 9C, and 9D illustrate the female housing 3 and the male housing 5 being engaged, while the CPA device 8 is at a pre-lock position, and while the TPA device 6 (visible in FIG. 9A, for example), is at a full-lock position.

As shown in FIGS. 8A, 9A, and 9B, the protruding members 43 have entered the elongated slot 108 of the male housing 5.

As shown in FIG. 9B, wherein the CPA device is at a pre-lock position, the CPA device 8 has its wedge-like member 80 in a position adjacent to the interior bridge member 60. As depicted in FIG. 9B, the wedge-like member 80 is in a position corresponding to the first window 55 (shown in FIG. 2C) of the female housing 3.

FIG. 9B shows the engaging member 61 on an interior of the female housing 3. The cut-out portion 82 of the CPA device 8 engages with the engaging member 61 of the female housing 3, when the CPA device 8 is at a pre-lock position.

To signify completed entry of the wedge-like member 80 into the first window 55, a sound (preferably, a clicking sound or the like) may be heard.

Figure 11A:
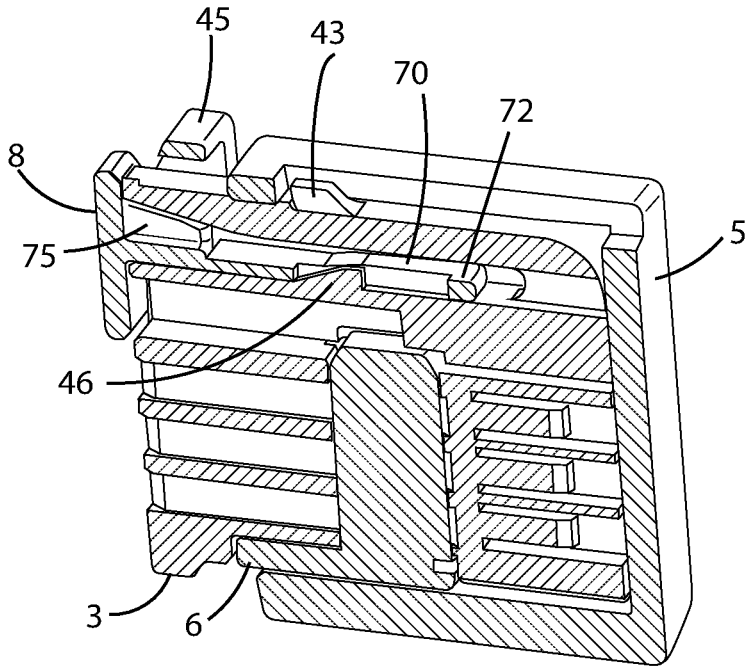
FIG. 11A is a cross-sectional view, taken along line 11A-11A in FIG. 10.
Figure 11B:
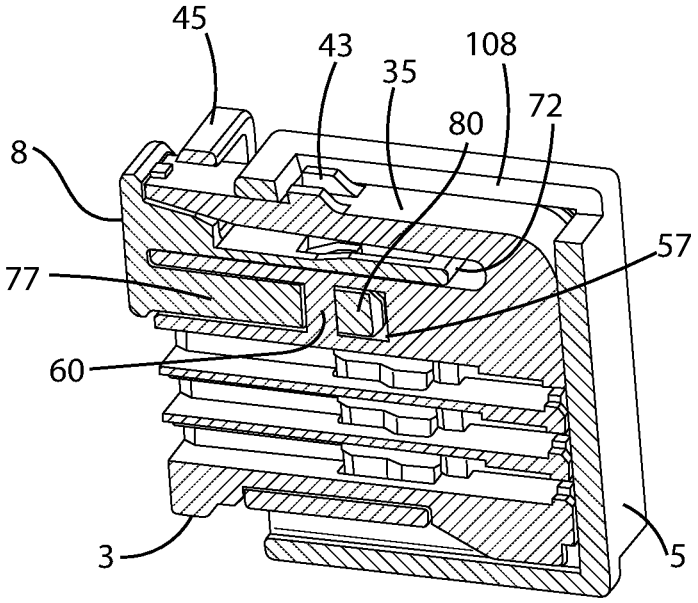
FIG. 11B is a cross-sectional view, taken along line 11B-11B in FIG. 10.
Figure 11C:
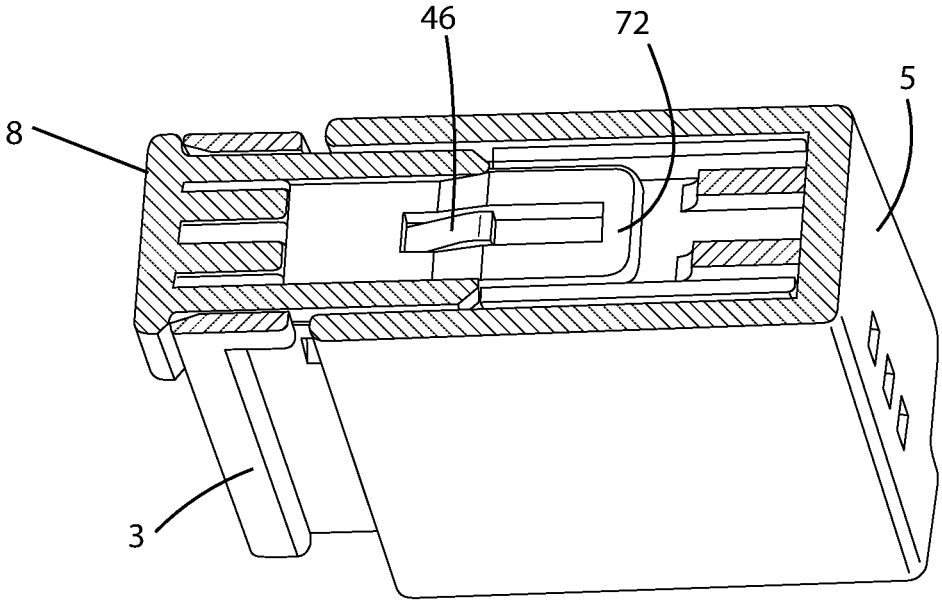
FIG. 11C is a cross-sectional view, taken along line 11C-11C in FIG. 10.
Figure 11D:
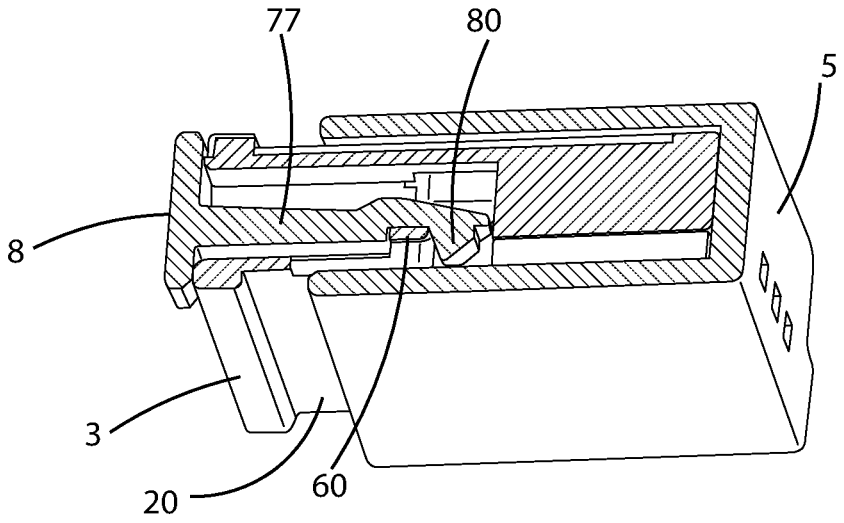
FIG. 11D is a cross-sectional view, taken along line 11D-11D in FIG. 10.

To facilitate the wedge-like member 80 first moving into the first window 55, second traversing the interior bridge member 60, and third moving into the second window 57, the front face of the wedge-like member 80 is preferably formed to have an inclined shape (see FIGS. 3A, 9D, and 11D, for example). The front face of the wedge-like member 80 is a face of the wedge-like member 80 disposed toward the front ledge 81.

The wedge-like member 80 is on the second flexible side member 77, which provides a spring-like action or resilience property.

At a pre-lock position (as illustrated in FIGS. 9A, 9B, and 9C, for example), the side end portion 72 of the CPA device 8 has traversed the ramp-like member 46 of the female housing 3 and has passed beyond the end portion 50. When the side end portion 72 passes beyond the end portion 50, a sound (preferably a clicking sound or the like) may be heard. When the side end portion 72 passes beyond the end portion 50, the end portion 50 penetrates the opening 92.

At this time, the wedge-like member 80 is fitted inside the first window 55 and is in contact with the interior bridge member 60, and the wedge-like member 80 is held in place, at least partly, by the resiliency of the second flexible side member 77, and thus the CPA device 8 is prevented from easily moving further forward into the female housing 3. Also, at this time, the end portion 50 is penetrating the opening 92, and the side end portion 72 is held in place, at least partly, by the resiliency of the first flexible side member 70, and thus the CPA device 8 is prevented from easily moving backward out from the female housing 3.

Figure 10:
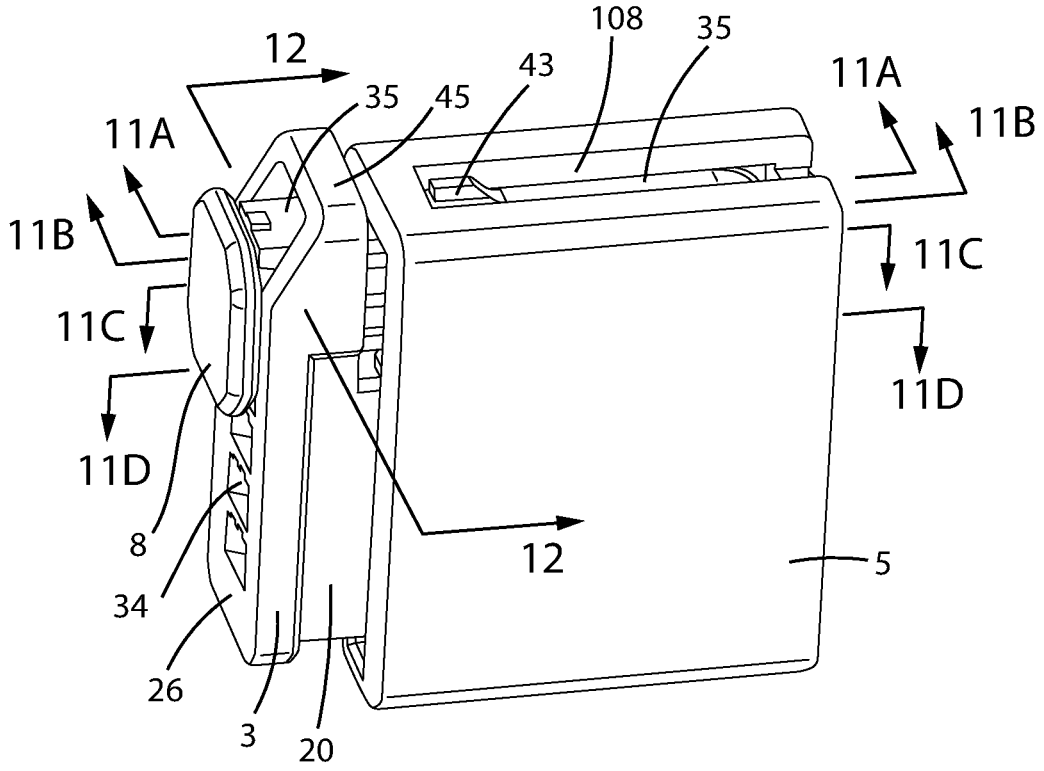
FIG. 10 is a perspective view of the female housing, male housing, and CPA device shown in FIG. 1, with the female housing coupled with the male housing, and with the CPA device inserted into the female housing at a full-lock position.

FIG. 10 is a perspective view of the female housing, male housing, and CPA device shown in FIG. 1, with the female housing coupled with the male housing, and with the CPA device inserted into the female housing at a full-lock position.

Figure 12:
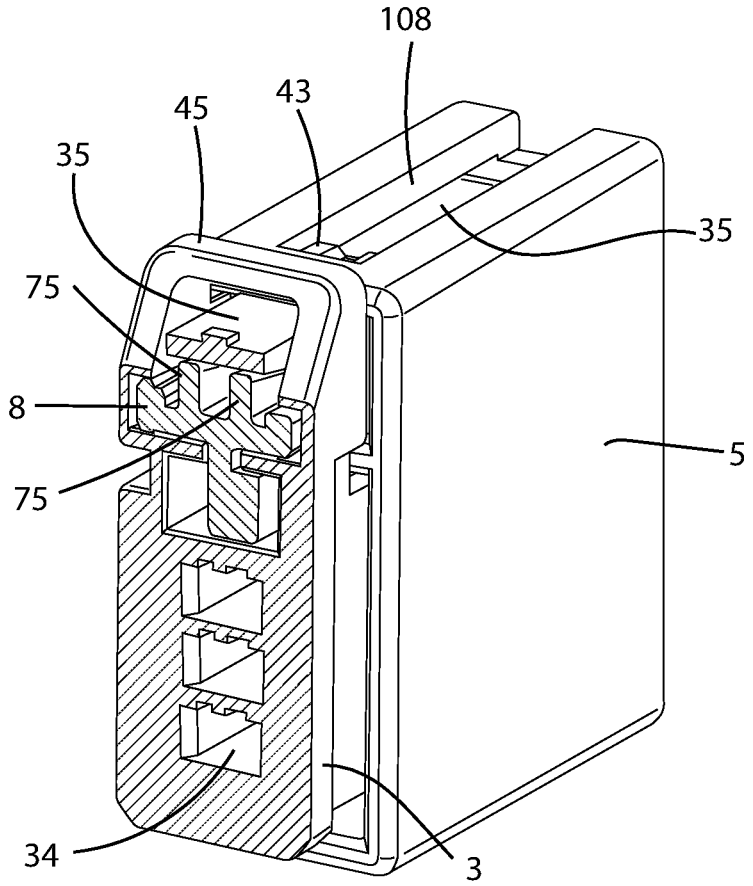
FIG. 12 is a cross-sectional view, taken along line 12-12 in FIG. 10.

FIG. 11A is a cross-sectional view, taken along line 11A-11A in FIG. 10. FIG. 11B is a cross-sectional view, taken along line 11B-11B in FIG. 10. FIG. 11C is a cross-sectional view, taken along line 11C-11C in FIG. 10. FIG. 11D is a cross-sectional view, taken along line 11D-11D in FIG. 10. FIG. 12 is a cross-sectional view, taken along line 12-12 in FIG. 10.

The manner in which the CPA device 8 is placed at a full-lock position with the female housing 3 shall now be described, with reference to FIGS. 10, 11A, 11B, 11C, 11D, and 12. When the CPA device 8 is at a full-lock position, this can provide assurance that the female housing 3 is fully and properly engaged, coupled, and locked with the male housing 5.

When the female housing 3 enters the opening 110 of the male housing 5, the protruding members 43 of the female housing 3 enter the elongated slot 108 of the male housing 5. When the CPA device 8 is at a pre-lock position, the flexible member 35 may be pushed downward toward an interior of female housing 3, permitting the protruding members 43 to go downward, which could facilitate the female housing 3 being pulled away from the male housing 5 if desired.

However, when the CPA device 8 is at a full-lock position, as shown in FIGS. 10, 11A, 11B, 11C, 11D, and 12, the side ledges 75 of the CPA device 8 will prevent the flexible member 35 of the female housing 3 from being pushed downward toward an interior of female housing 3, and thus the protruding members 43 cannot go downward. Thus, the female housing 3 cannot be pulled away from the male housing 5.

The CPA device 8 is moved to a full-lock position in the female housing 3 when the CPA device 8 is pushed deeper into the female housing 3, from a pre-lock position to a full-lock position. When the CPA device 8 moves from a pre-lock position to a full-lock position, the wedge-like member 80 of the CPA device 8 moves out from the first window 55, traverses the interior bridge member 60 between the first window 55 and the second window 57, and moves into the second window 57. See FIGS. 11B and 11D.

Upon entry of the wedge-like member 80 into the second window 57, a sound (preferably a clicking sound or the like) may be heard. When, or approximately when, the wedge-like member 80 enters the second window 57, as shown in FIGS. 11B and 11D, the side end portion 72 of the first flexible side member 70 moves deeper into the female housing 3 while the end portion 50 is penetrating the opening 92. In addition, when the CPA device 8 is at a full-lock position, the side ledges 75 of the CPA device 8 are positioned beneath the flexible member 35, as shown in FIG. 12, and thus, the flexible member 35 cannot be pushed downward toward an interior of the female housing 3, and consequently, the protruding members 43 of the flexible member 35 cannot go downward to try to move out from the elongated slot 108 of the male housing 5. Thus, when the CPA device 8 is at a full-lock position, the female housing 3 cannot be pulled away from the male housing 5, and this serves to assure that the female housing 3 and the male housing 5, when engaged, remain fully locked together.

Figure 13:
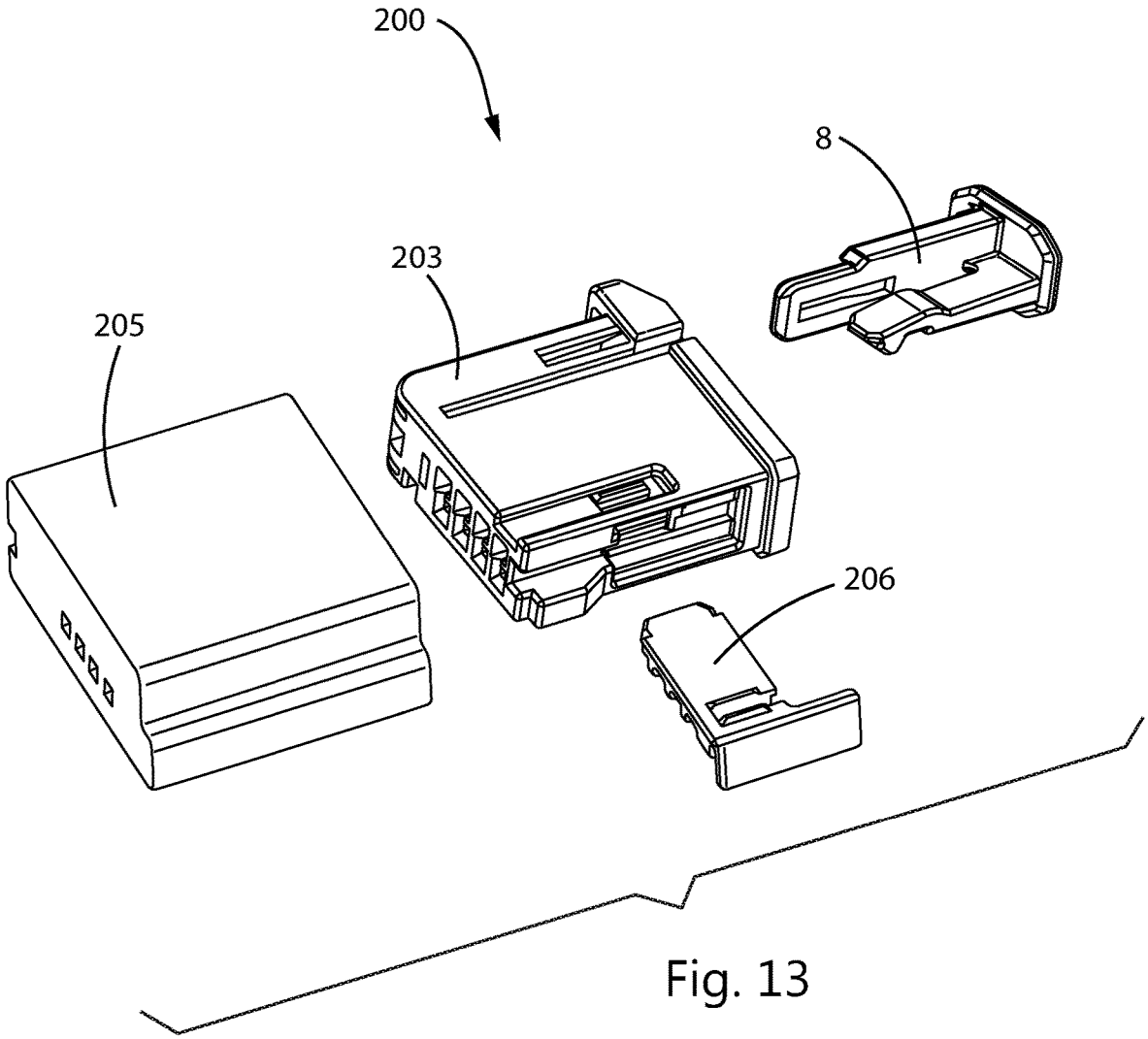
FIG. 13 is an exploded perspective view of the connector system of the present invention, showing a male housing, a female housing, a connector position assurance (CPA) device, and an optional terminal position assurance (TPA) device, illustrating a second embodiment of the present invention.

FIG. 13 is an exploded perspective view of the connector system of the present invention, showing a male housing, a female housing, a connector position assurance (CPA) device, and an optional terminal position assurance (TPA) device, illustrating a second embodiment of the present invention.

The second embodiment, shown in FIG. 13, illustrates a four-pin configuration wherein a male housing and a female housing have apertures and features accommodating four pins or four terminals for electrical wires and/or electrical connections.

As shown in FIG. 13, the connector system is generally referred to by reference number 200, and includes a female housing 203, a male housing 205, a connector position assurance (CPA) device 8, and an optional terminal position assurance (TPA) device 206.

Figure 14A:
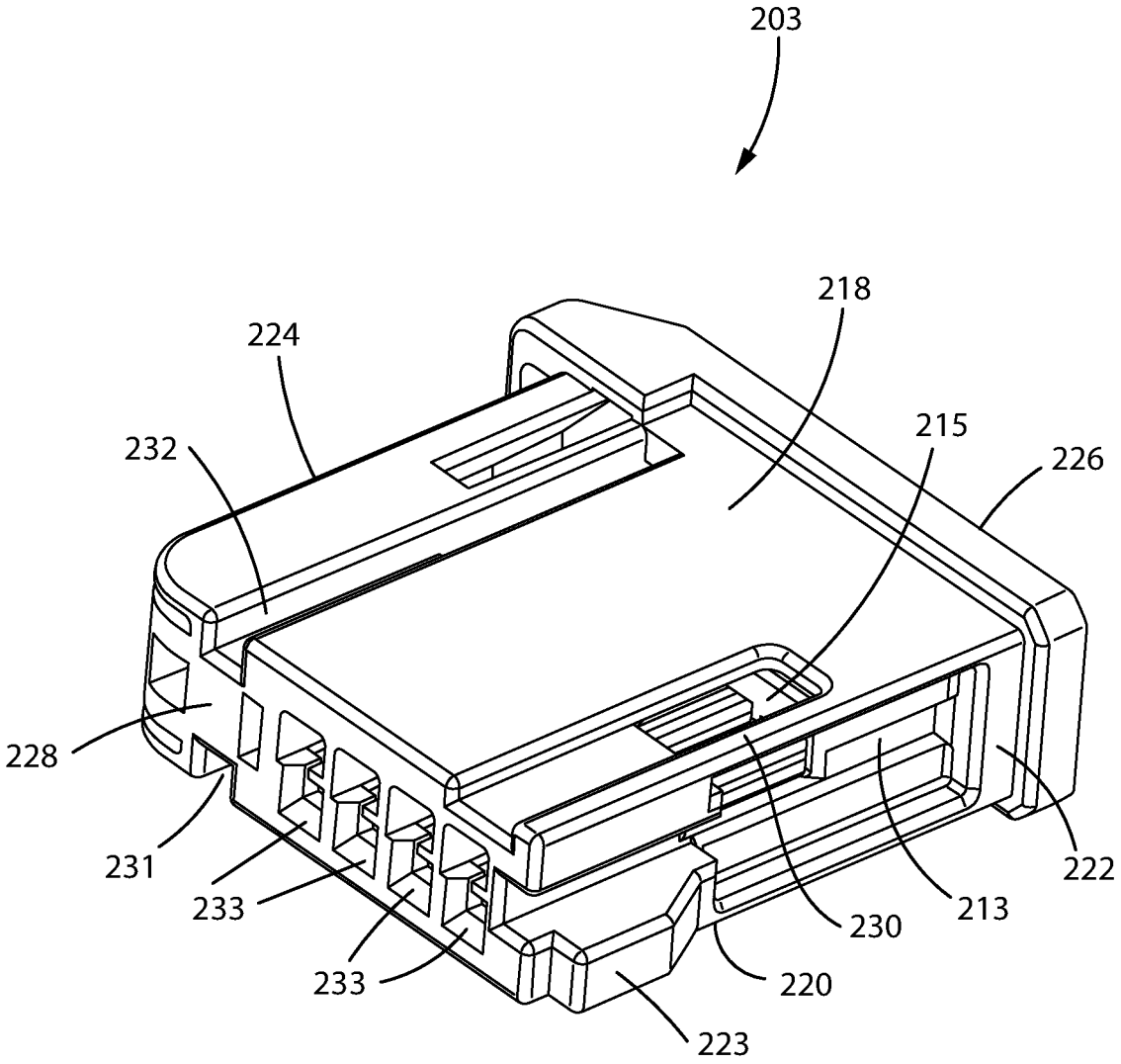
FIG. 14A is a first perspective view of the female housing of FIG. 13.
Figure 14B:
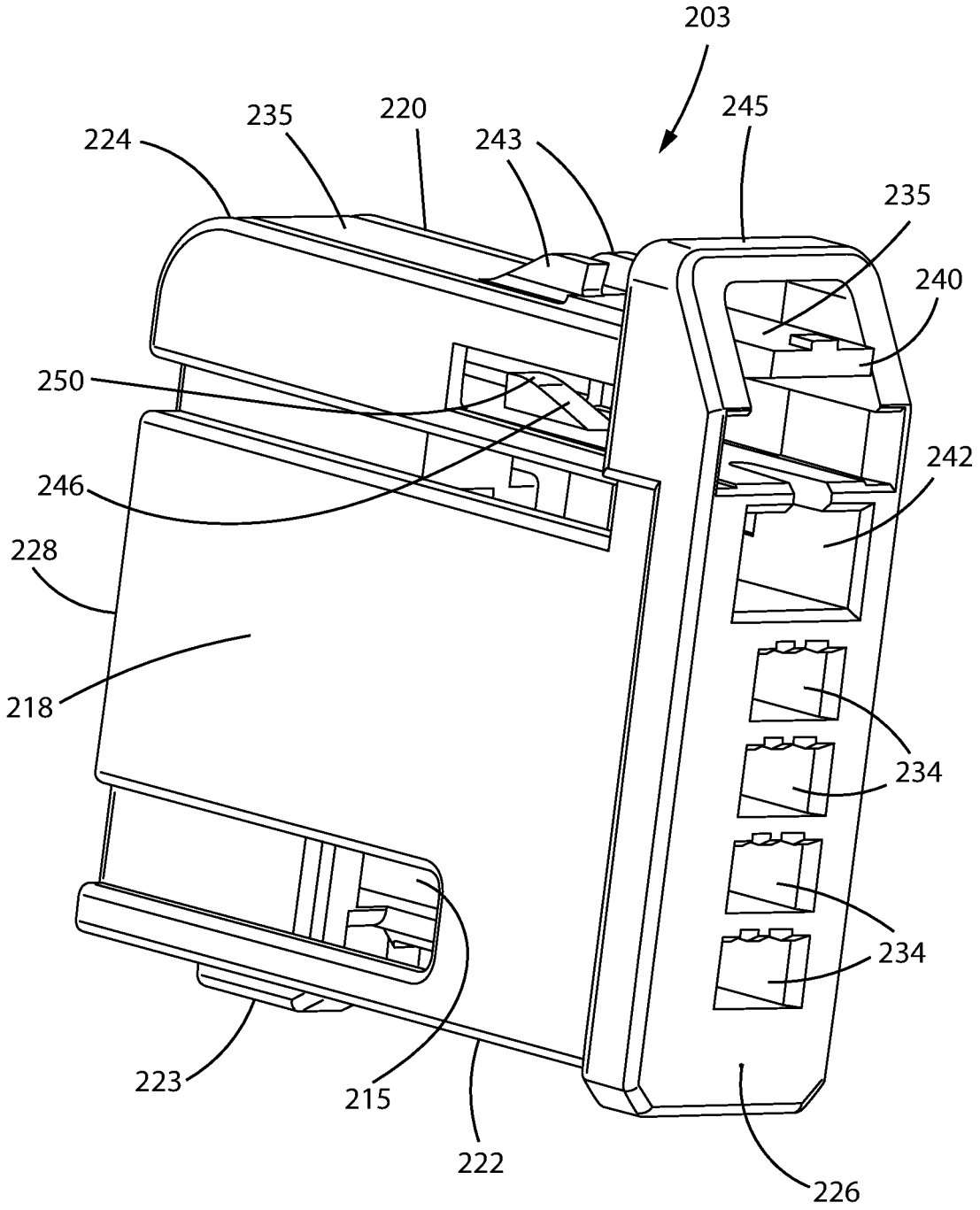
FIG. 14B is a second perspective view of the female housing of FIG. 13.
Figure 14C:
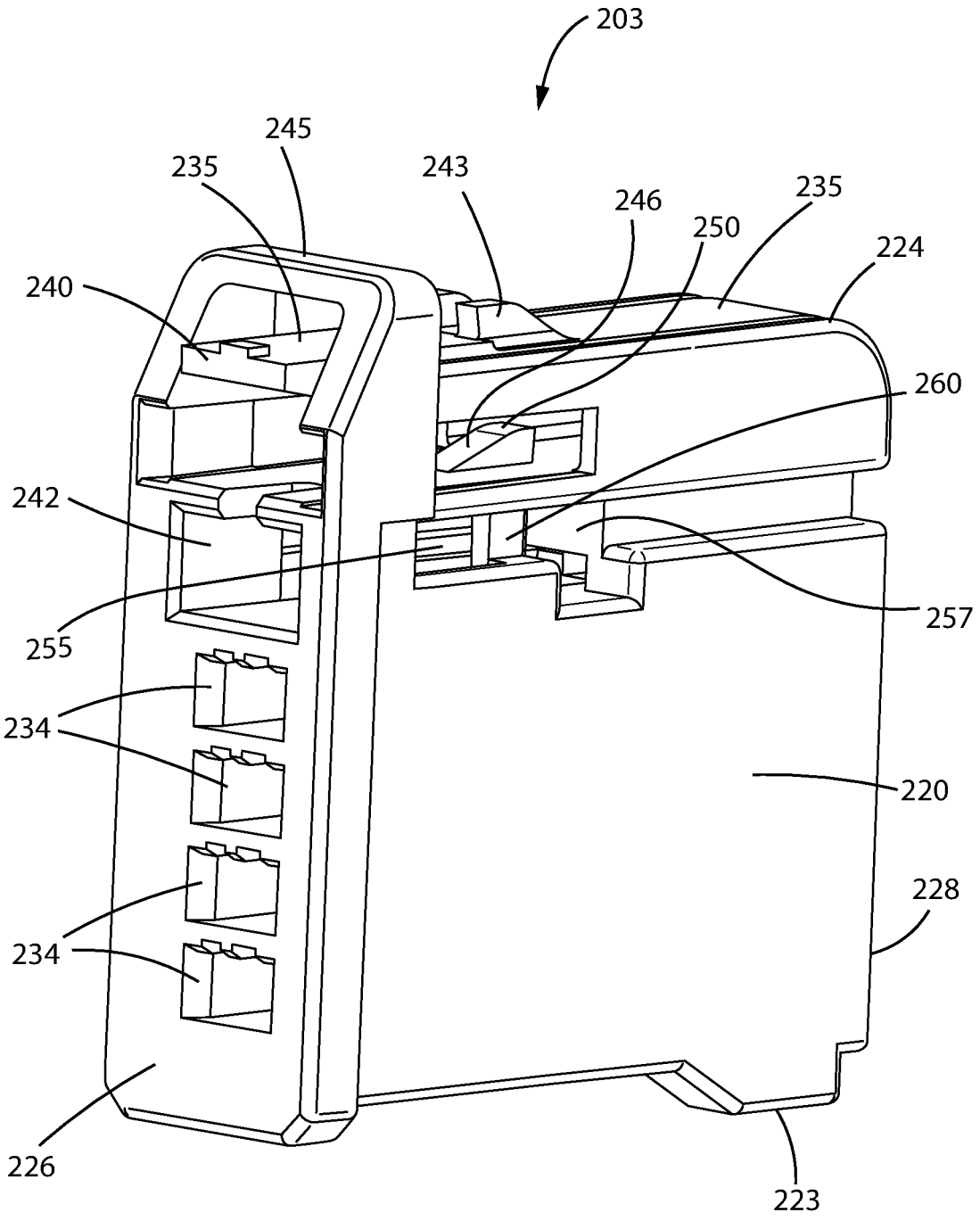
FIG. 14C is a third perspective view of the female housing of FIG. 13.

FIG. 14A is a first perspective view of the female housing of FIG. 13. FIG. 14B is a second perspective view of the female housing of FIG. 13. FIG. 14C is a third perspective view of the female housing of FIG. 13.

The female housing 203 has an upper side 218, a lower side 220, a first side 222, a second side 224, a front end side 226, and a back end side 228. A side slot 213 is located on the first side 222 of the female housing 203. A top slot 215 is located on the upper side 218 of the female housing 203. A protrusion 223 is located on the first side 222 of the female housing 203. An exterior bridge member 230 is located at a position adjacent to the top slot 215. A groove 231 is located on a lower side 220 of the female housing 203. Four terminal slots 233 are located on the back end side 228.

Four terminal slots 234 are located on the front end side 226. A flexible member 235 is located on the female housing, as shown in FIG. 14B. The flexible member 235 has a front end 240. Two protruding members 243 are formed on the flexible member 235. The front side 226 of the female housing 203 forms an opening 242. A substantially U-shaped member 245 is on the female housing 203. In the female housing 203, there is a ramp-like member 246 which has an end portion 250.

A first window 255 and a second window 257 are formed in the lower side 220 of the female housing 203, as shown in FIG. 14C. An interior bridge member 260 is located in the female housing 203, as shown in FIG. 14C. The first window 255 is adjacent to the interior bridge member 260. The second window 257 is also adjacent to the interior bridge member 260. The interior bridge member 260 is disposed between the first window 255 and the second window 257.

As explained later, the side slot 213 receives the optional TPA device 206. The exterior bridge member 230 is located between the side slot 213 and the top slot 215.

FIG. 14B shows the flexible member 235 extending along the second side 224 of the female housing 203, such that the front end 240 of the flexible member 235 extends to a position near the substantially U-shaped member 245. The protruding members 243 extend from the flexible member 235 at an intermediate area of the flexible member 235.

Figure 15:
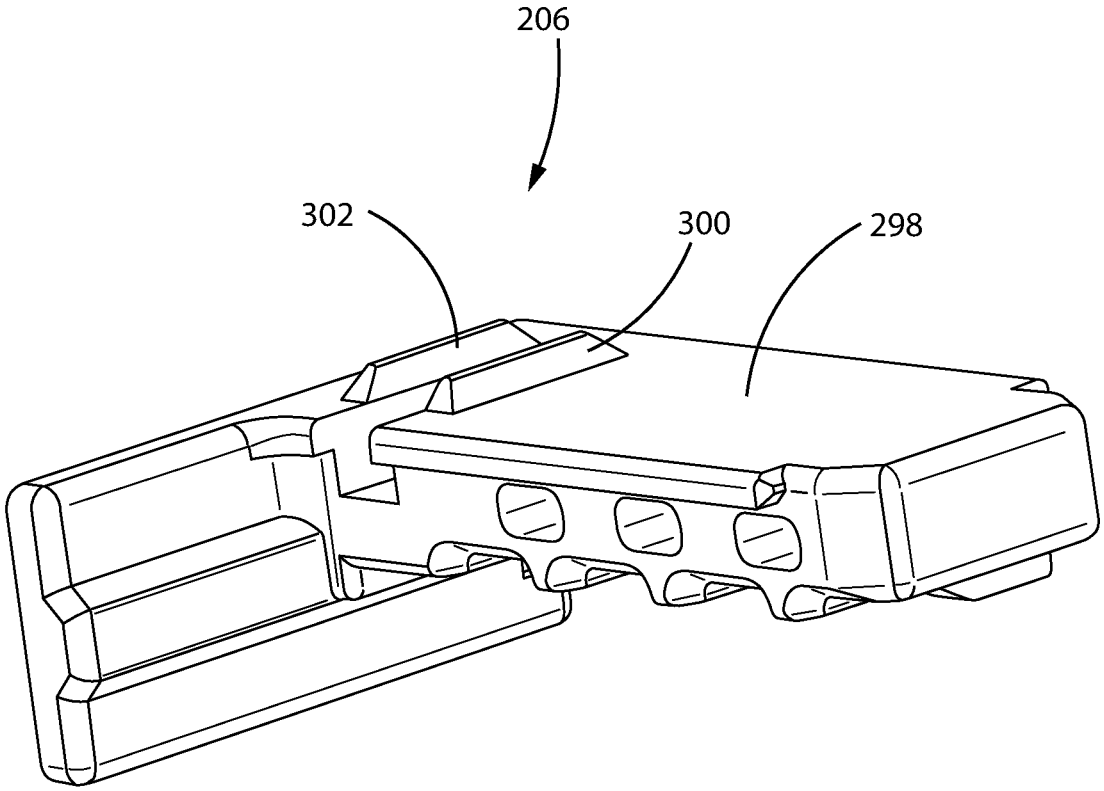
FIG. 15 is a perspective view of the TPA device of FIG. 13.

FIG. 15 is a perspective view of the TPA device of FIG. 13. As shown in FIG. 15, the TPA device 206 is substantially L-shaped. However, the general shape of the TPA device 206 is not limited to such a configuration. A first elongated member 300 and a second elongated member 302 extend from a top portion 298 of the TPA device 206.

Figure 16A:
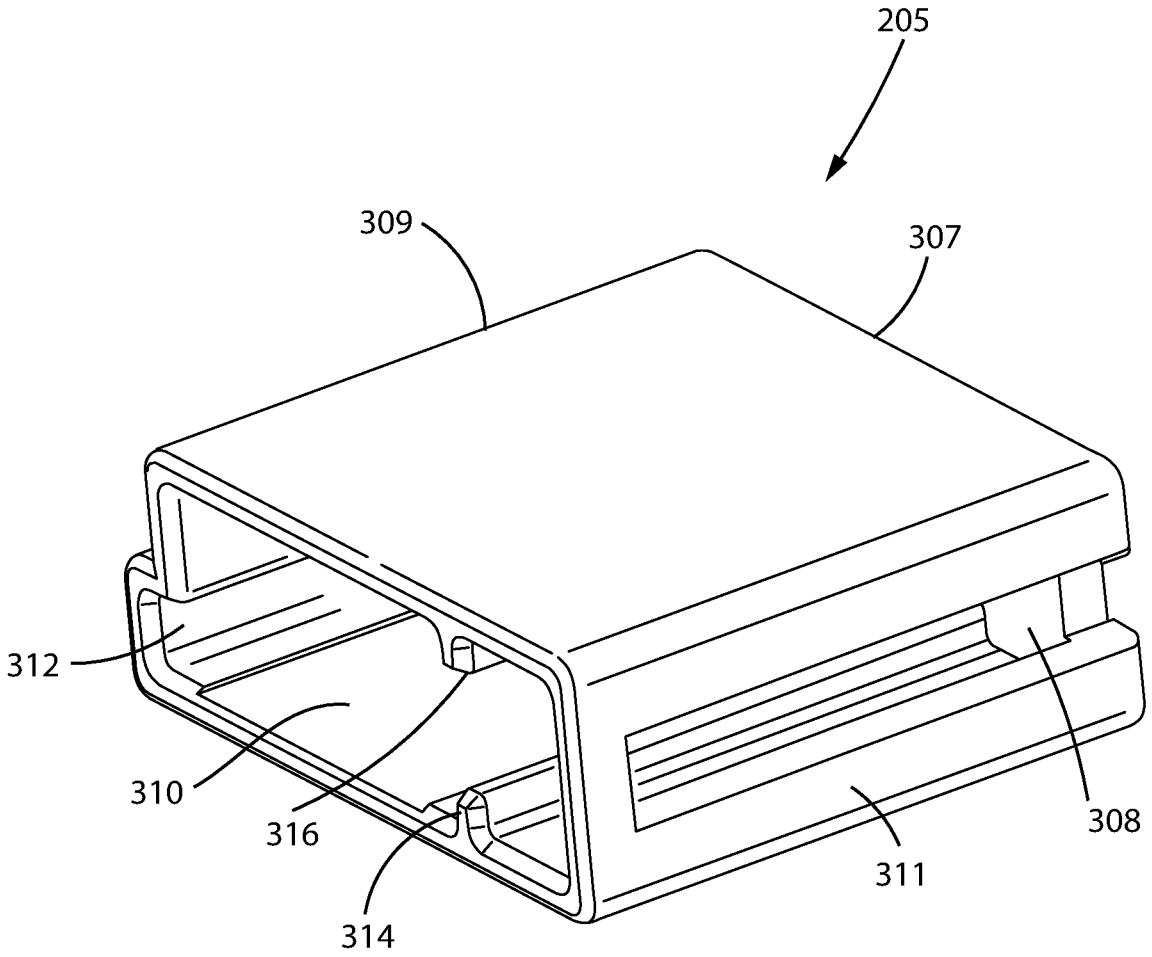
FIG. 16A is a perspective view of the male housing of FIG. 13.
Figure 16B:
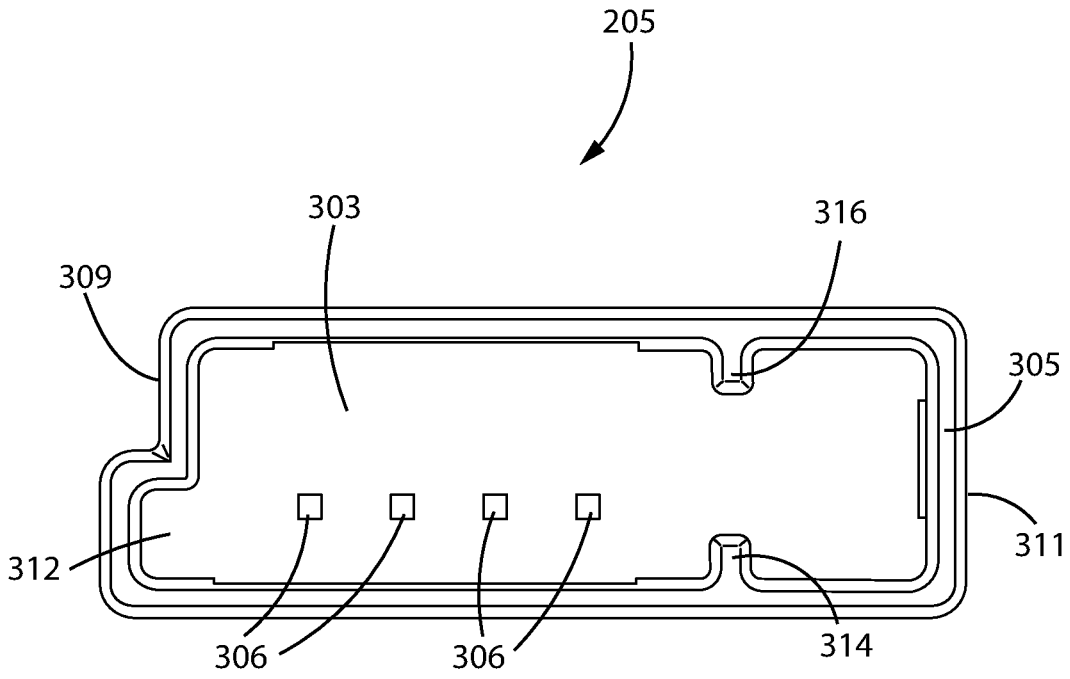
FIG. 16B is an elevational view of the male housing of FIG. 13.

FIG. 16A is a perspective view of the male housing of FIG. 13. FIG. 16B is an elevational view of the male housing of FIG. 13. The male housing 205 is shown in a generic form in FIGS. 13, 16A, and 16B, for example, such that some details of the male housing 205 are not illustrated. The male housing 205 has a first end portion 305, a second end portion 307, a first side 309, a second side 311, an opening 310, a guide groove 312, a first guide protrusion 314, and a second guide protrusion 316. An elongated slot 308 is formed in the second side 311. Also, the male housing 205 has four terminal apertures 306.

As shown in FIG. 16B, the space 303 is the region where the optional TPA device 206 is located, if the TPA device 206 is inserted to a full-lock position in the female housing 203 and then the female housing 203 is inserted into the opening 310 of the male housing 205.

When the female housing 203 is inserted into the opening 310 of the male housing 205, the protrusion 223 is received by the guide groove 312.

Figure 17A:
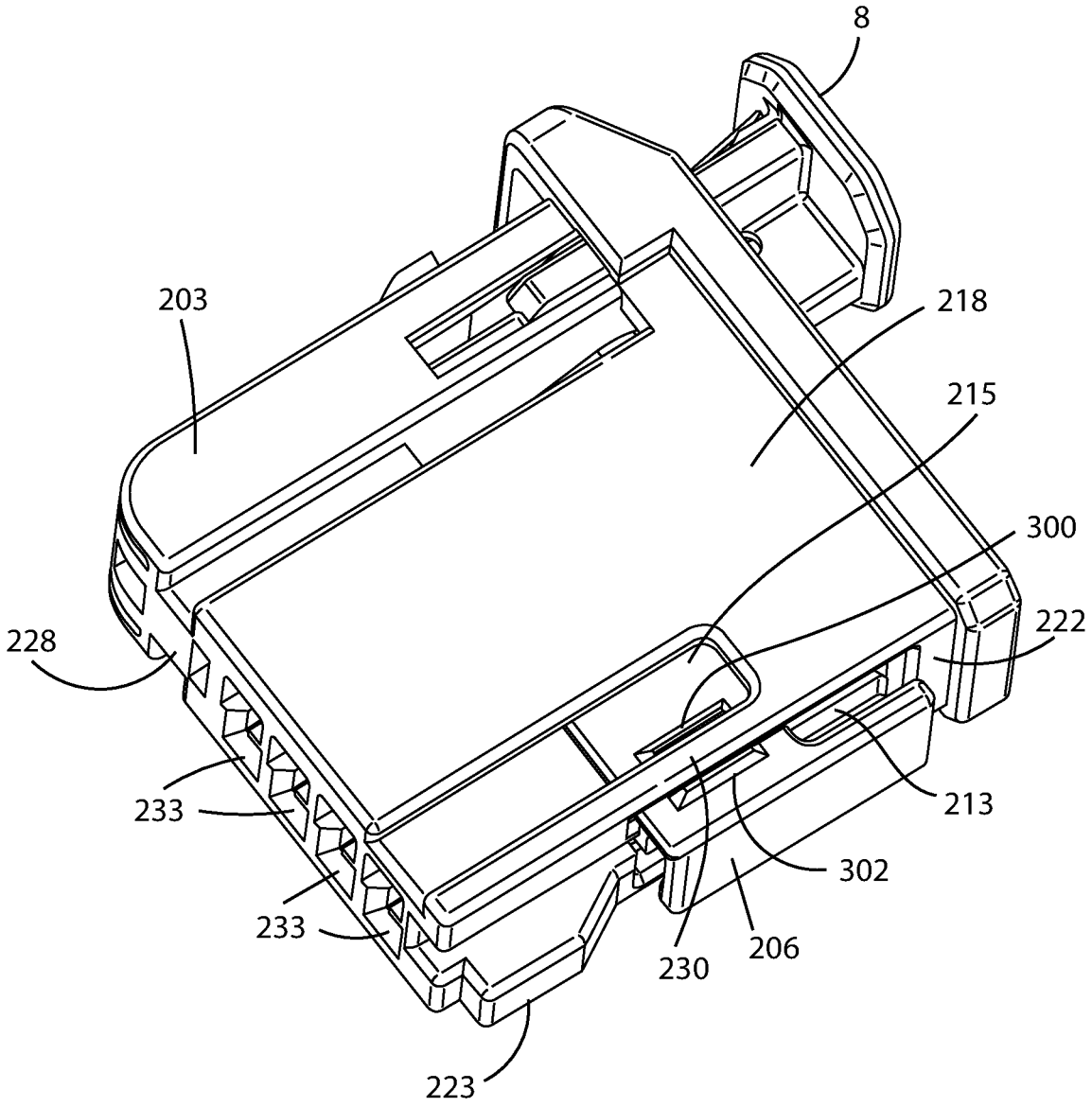
FIG. 17A is a first perspective view of the female housing of FIG. 13, with the TPA device of FIG. 13 at a pre-lock position in the female housing, and with the CPA device of FIG. 13 at a pre-lock position in the female housing.
Figure 17B:
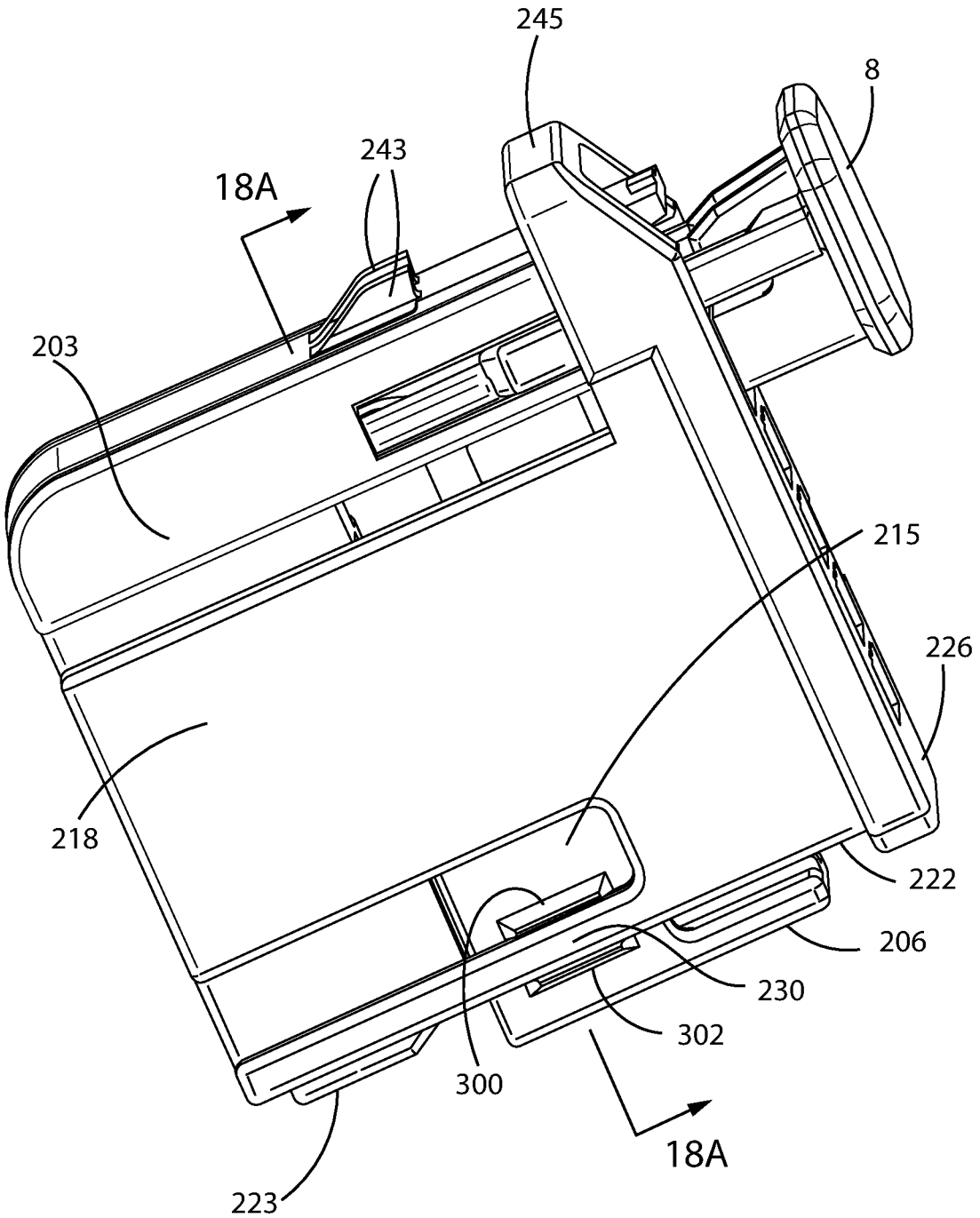
FIG. 17B is a second perspective view of the female housing of FIG. 13, with the TPA device of FIG. 13 at a pre-lock position in the female housing, and with the CPA device of FIG. 13 at a pre-lock position in the female housing.

FIG. 17A is a first perspective view of the female housing of FIG. 13, with the TPA device of FIG. 13 at a pre-lock position in the female housing, and with the CPA device of FIG. 13 at a pre-lock position in the female housing. FIG. 17B is a second perspective view of the female housing of FIG. 13, with the TPA device of FIG. 13 at a pre-lock position in the female housing, and with the CPA device of FIG. 13 at a pre-lock position in the female housing.

As shown in FIG. 17A, the TPA device 206 is inserted into the side slot 213 of the female housing 203 such that the first elongated member 300 passes beneath the exterior bridge member 230 and becomes positioned within the top slot 215 of the female housing 203, the TPA device 206 being in a pre-lock position. As shown in FIGS. 17A and 17B, the CPA device 8 is at a pre-lock position with the female housing 203, while the TPA device 206 is similarly at a pre-lock position.

With the TPA device 206 and CPA device 8 at pre-lock positions, the female housing 203 and the two devices 206, 8 are in a stable configuration and are ready to be transported.

With the CPA device 8 at a pre-lock position inside the female housing 203 (and the TPA device 206 now at a pre-lock position inside the female housing 203), the female housing 203 is ready to be transported to a location where the female housing 203 can be engaged with the male housing 205.

Figure 17C:
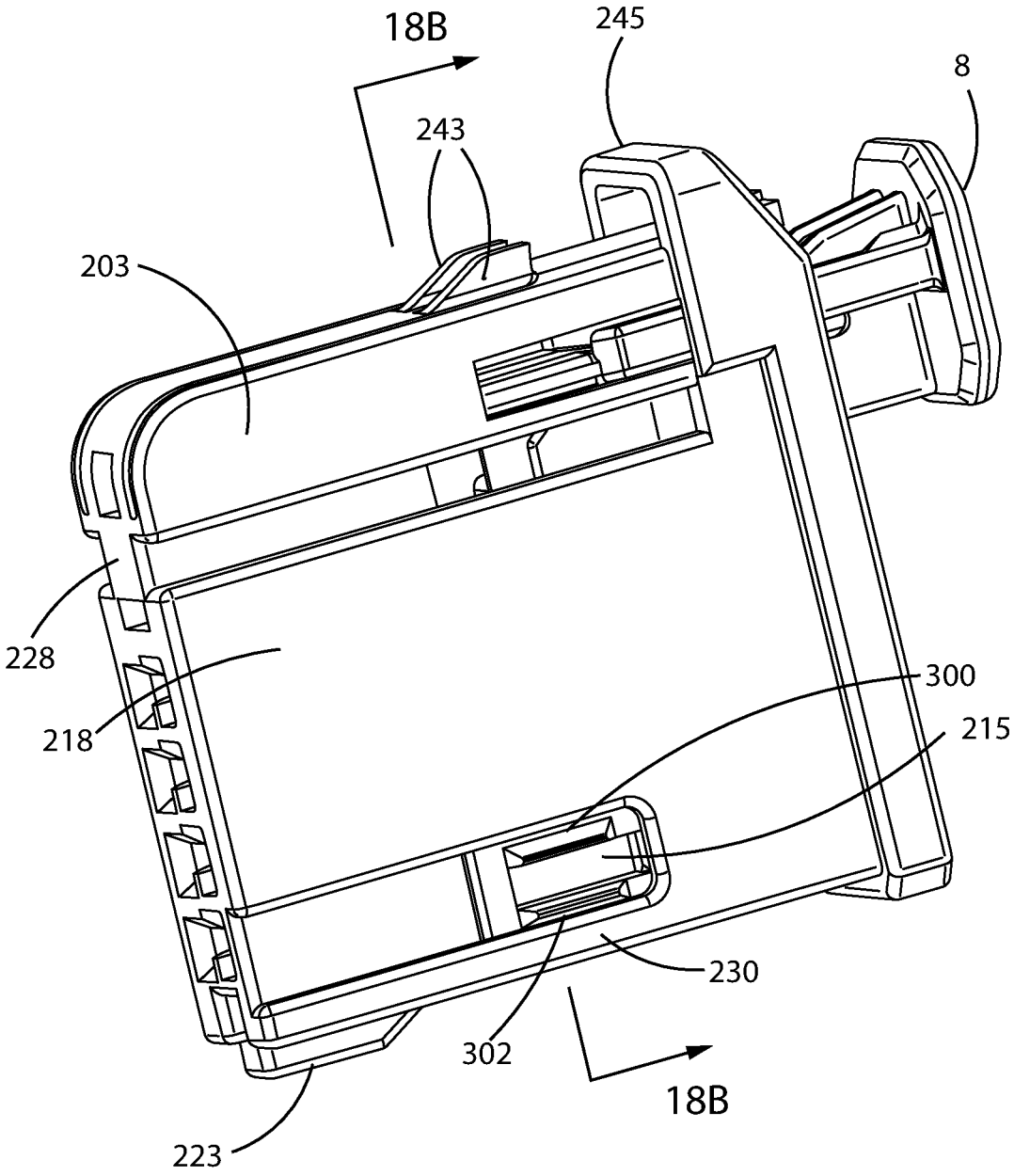
FIG. 17C is a perspective view of the female housing of FIG. 13, with the TPA device of FIG. 13 at a full-lock position in the female housing, and with the CPA device of FIG. 13 at a pre-lock position in the female housing.

FIG. 17C is a perspective view of the female housing of FIG. 13, with the TPA device of FIG. 13 at a full-lock position in the female housing, and with the CPA device of FIG. 13 at a pre-lock position in the female housing. After a set of terminals (not shown) is inserted through the set of terminal slots 233 of the female housing 203, the TPA device 206 is pushed further inward into the side slot 213. At this time, the second elongated member 302 of the TPA device 206 is pushed past the exterior bridge member 230 of the female housing 203, and thus the second elongated member 302 arrives into the top slot 215 of the female housing 203. The TPA device 206 is then at a full-lock position, as shown in FIG. 17C.

Figure 18A:
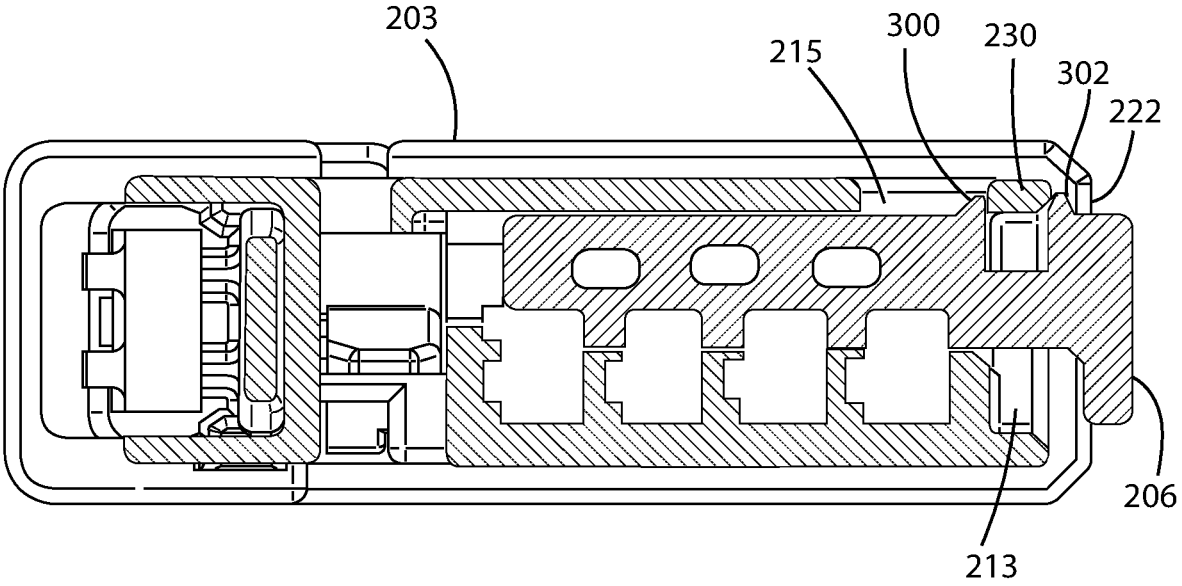
FIG. 18A is a cross-sectional view, taken along line 18A-18A in FIG. 17B, showing the TPA device in a pre-lock position in the female housing.
Figure 18B:
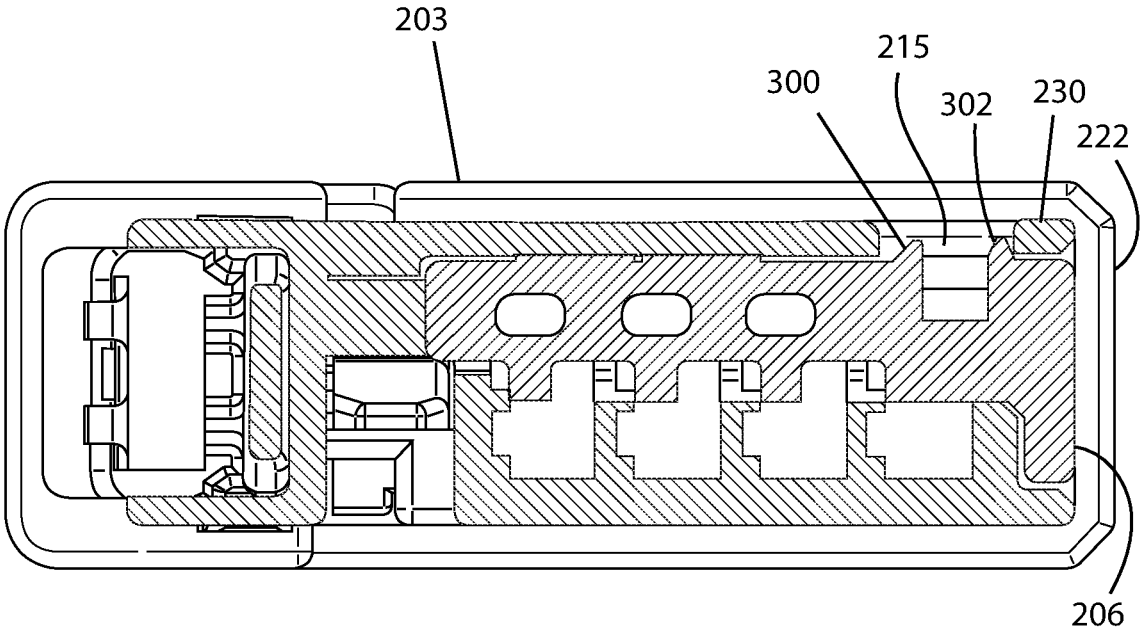
FIG. 18B is a cross-sectional view, taken along line 18B-18B in FIG. 17C, showing the TPA device in a full-lock position in the female housing.

FIG. 18A is a cross-sectional view, taken along line 18A-18A in FIG. 17B, showing the TPA device at a pre-lock position in the female housing. FIG. 18B is a cross-sectional view, taken along line 18B-18B in FIG. 17C, showing the TPA device at a full-lock position in the female housing.

As shown in FIG. 18A, the TPA device 206 is at a pre-lock position, when the first elongated member 300 of the TPA device 206 has been pushed into side slot 213 so that the first elongated member 300 proceeds past the exterior bridge member 230, wherein the first elongated member 300 is located in the top slot 215 and the second elongated member 302 is not in the top slot 215.

As shown in FIG. 18B, the TPA device 206 is at a full-lock position, when the first elongated member 300 and the second elongated member 302 of the TPA device 206 have both been pushed into side slot 213 so that the first elongated member 300 and the second elongated member 302 both proceed past the exterior bridge member 230, wherein the first elongated member 300 and the second elongated member 302 are both located in the top slot 215.

As shown in FIG. 18B, the TPA device 206 is fully inserted into the female housing 203 so that no part of the TPA device 206 extends beyond the exterior edge of the first side 222 of the female housing 203. When the TPA device 206 is at a full-lock position within the female housing 203, the TPA device 206 has secured the set of terminals (not shown) intended to be joined with the female housing 203, and the female housing 203 is ready to be inserted into, and coupled with, the male housing 205. Thus, no part of the TPA device 206 extends beyond the exterior edge of the first side 222 of the female housing 203. When the TPA device 206 is at a full-lock position in the female housing 203, the female housing 203 is able to fully enter, unimpeded, into the opening 310 and guide groove 312 of the male housing 205. After the female housing 203, with the TPA device 206 at a full-lock position therein, has been fully inserted into the male housing 205, the CPA device 8 can be moved from a pre-lock position to a full-lock position by inserting the CPA device 8 further into the female housing 203. After the female housing 203 is inserted into the male housing 205, the movement of the CPA device 8 to a full-lock position provides assurance that the female housing 203 and male housing 205 are fully and properly engaged.

If the female housing 203 is to utilize the optional TPA device 206 (shown in FIG. 15), it is preferable that, first, the female housing 203 have its TPA device 206 at a pre-lock position therein and also have the CPA device 8 at a pre-lock position therein, and then, second, the female housing 203 be transported to an assembly destination with the devices 206 and 8 at pre-lock positions therein during such transport.

If the female housing 203 is not to utilize a TPA device, it is preferable that, first, the female housing 203 initially have the CPA device 8 at a pre-lock position therein, and then, second, the female housing 203 be transported to an assembly destination with the device 8 at a pre-lock position therein during such transport.

If the male housing 205 is to utilize a TPA device (not shown), it is preferable that, first, the male housing 205 have its TPA device at a pre-lock position therein, and then, second, the male housing 205 be transported to an assembly destination with its TPA device at a pre-lock position therein during such transport.

Figure 19A:
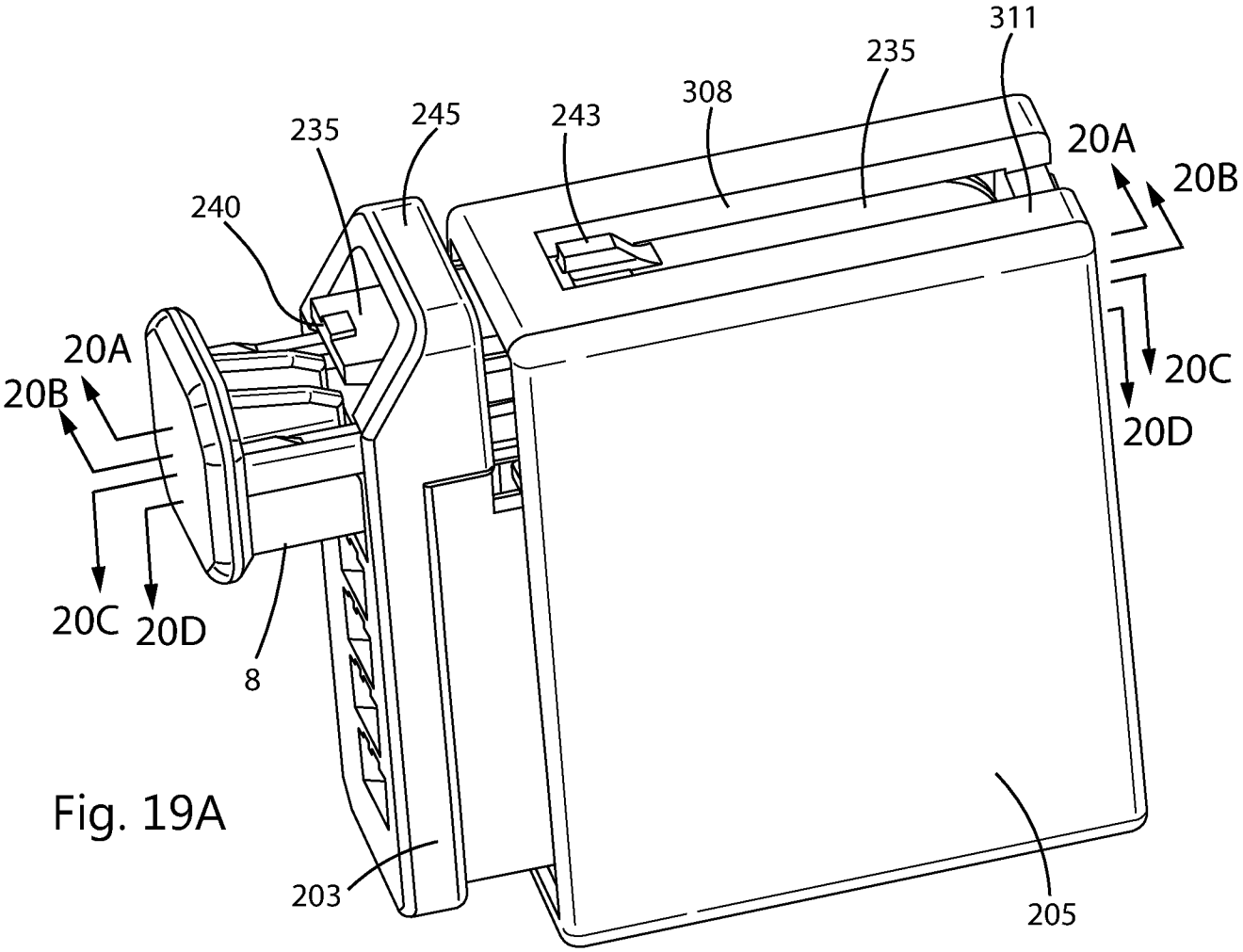
FIG. 19A is a first perspective view of the female housing, male housing, and CPA device shown in FIG. 13, with the female housing coupled with the male housing, and with the CPA device inserted into the female housing at a pre-lock position.
Figure 19B:
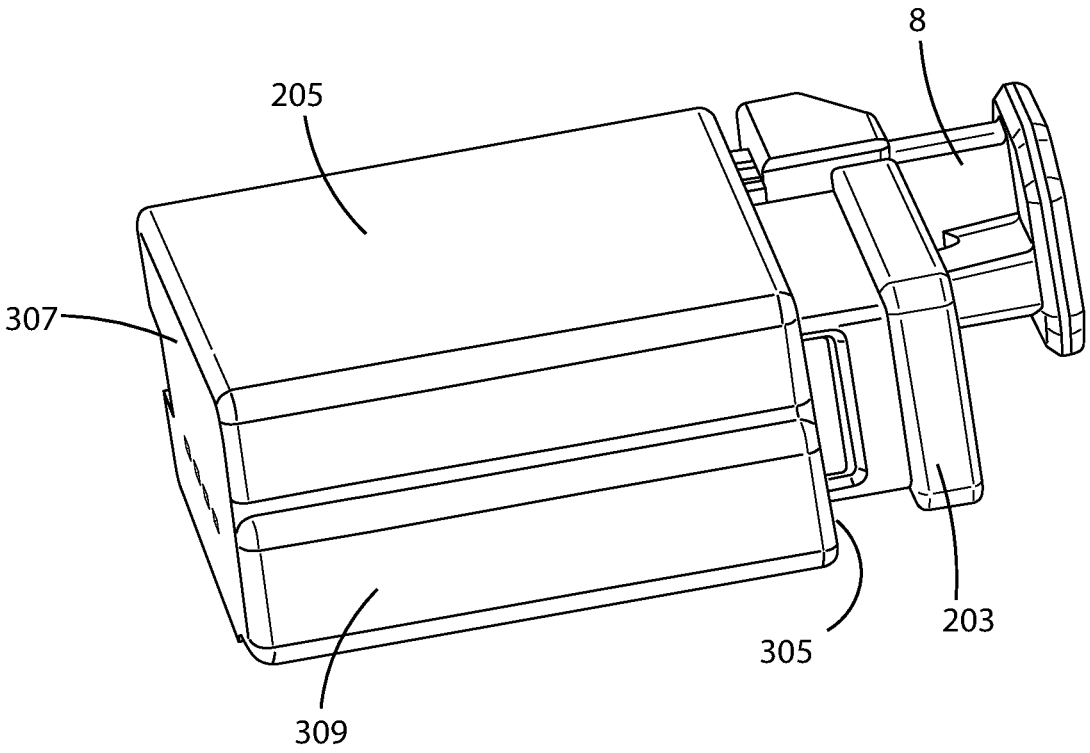
FIG. 19B is a second perspective view of the female housing, male housing, and CPA device shown in FIG. 13, with the female housing coupled with the male housing, and with the CPA device inserted into the female housing at a pre-lock position.

FIG. 19A is a first perspective view of the female housing, male housing, and CPA device shown in FIG. 13, with the female housing coupled with the male housing, and with the CPA device inserted into the female housing at a pre-lock position. FIG. 19B is a second perspective view of the female housing, male housing, and CPA device shown in FIG. 13, with the female housing coupled with the male housing, and with the CPA device inserted into the female housing at a pre-lock position.

Figure 20A:
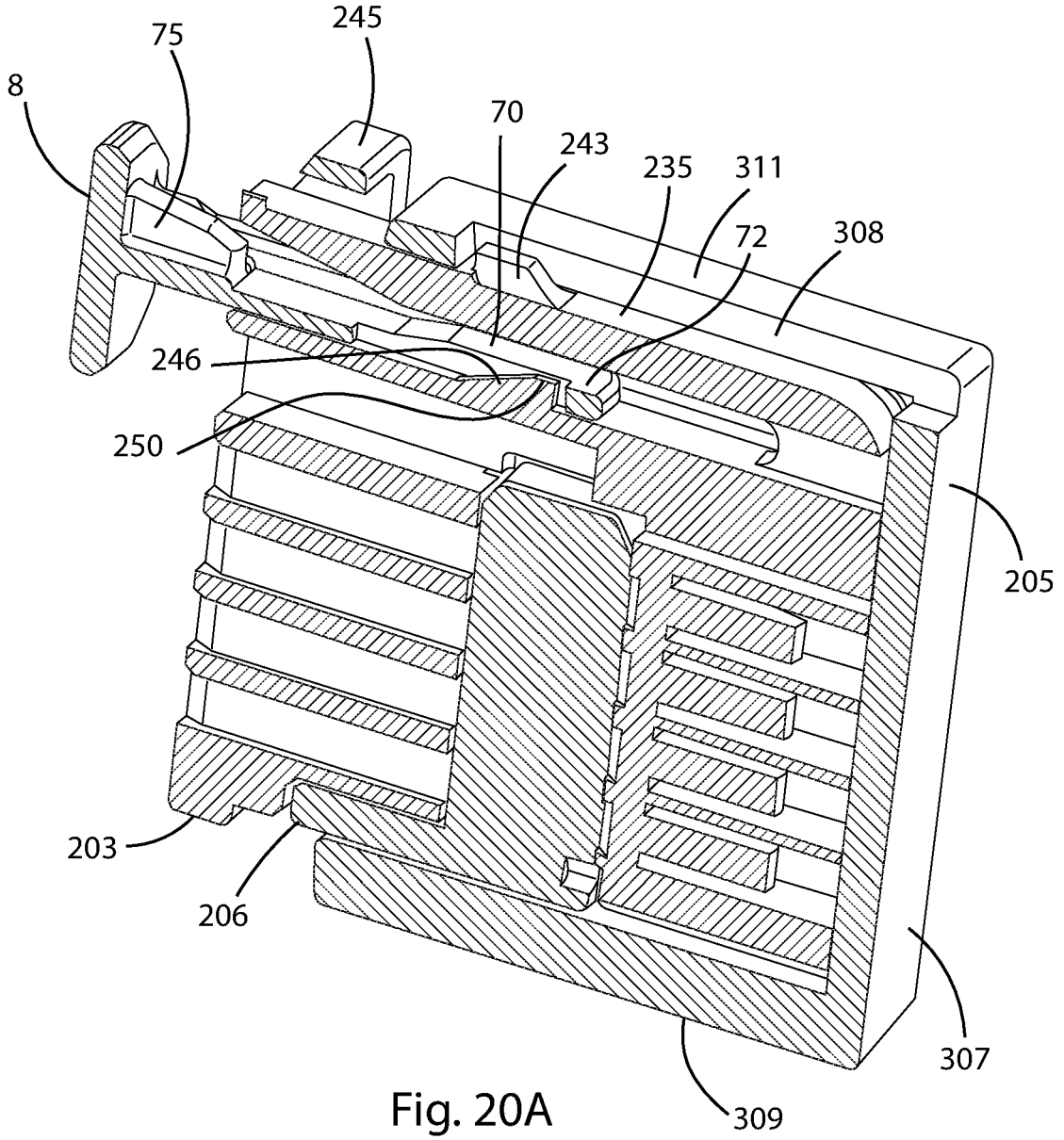
FIG. 20A is a cross-sectional view, taken along line 20A-20A in FIG. 19A.
Figure 20B:
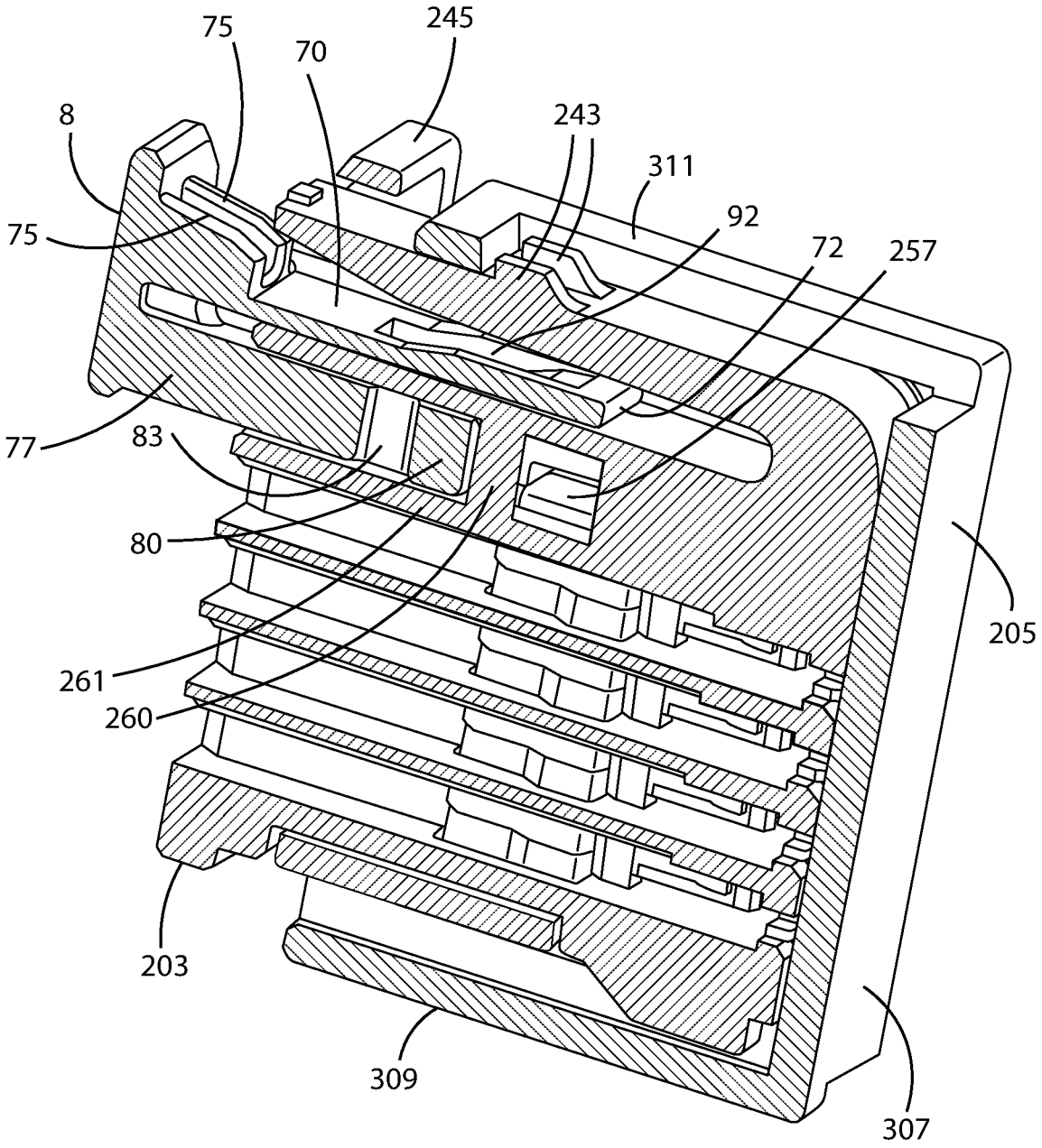
FIG. 20B is a cross-sectional view, taken along line 20B-20B in FIG. 19A.
Figure 20C:
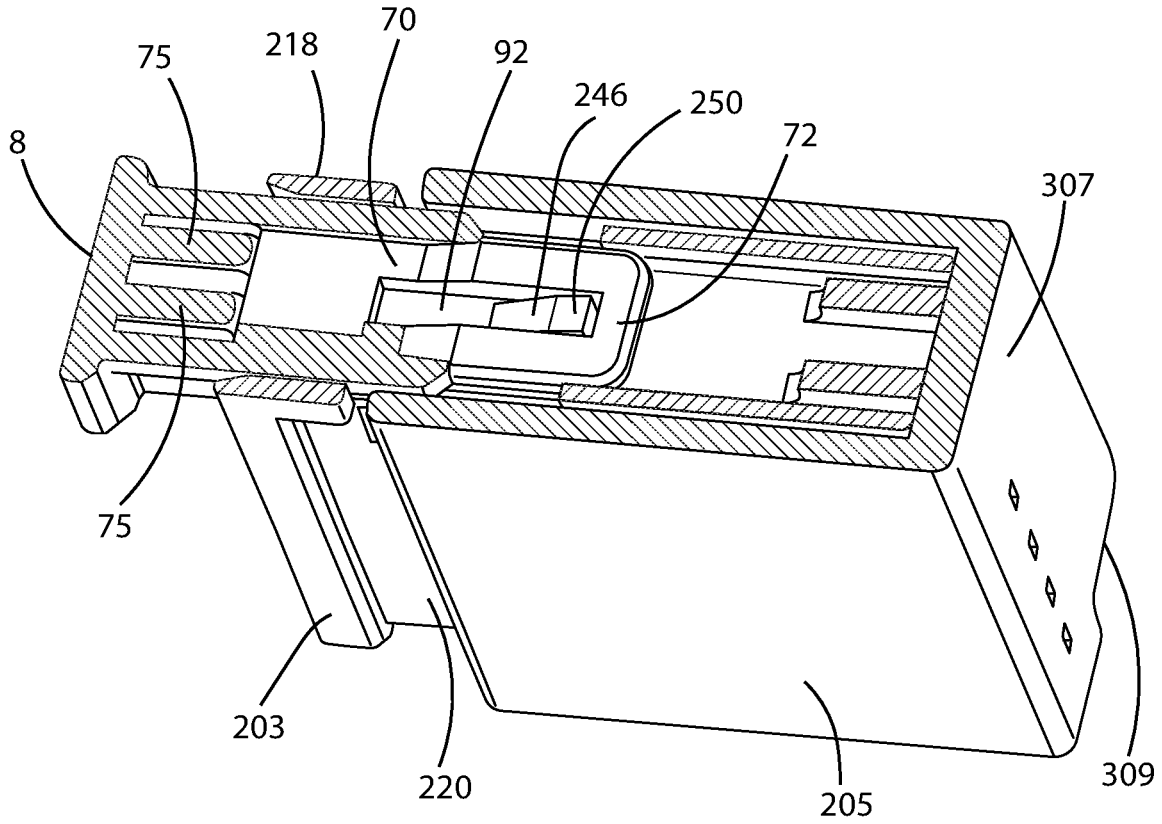
FIG. 20C is a cross-sectional view, taken along line 20C-20C in FIG. 19A.
Figure 20D:
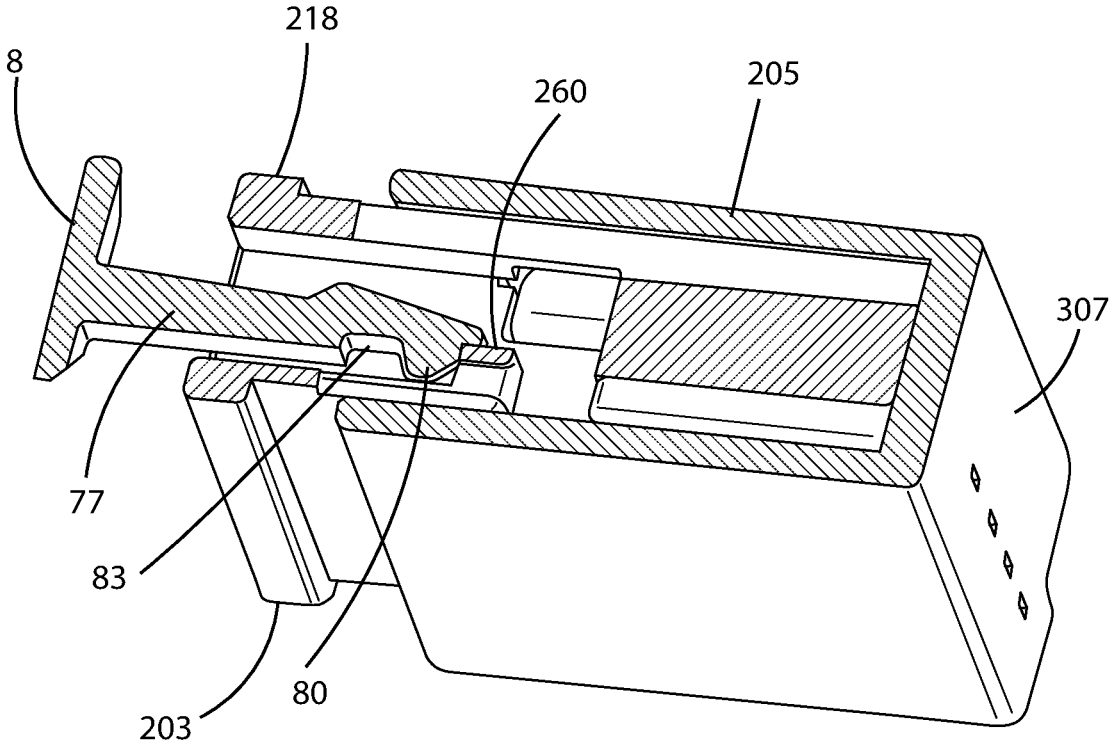
FIG. 20D is a cross-sectional view, taken along line 20D-20D in FIG. 19A.

FIG. 20A is a cross-sectional view, taken along line 20A-20A in FIG. 19A. FIG. 20B is a cross-sectional view, taken along line 20B-20B in FIG. 19A. FIG. 20C is a cross-sectional view, taken along line 20C-20C in FIG. 19A. FIG. 20D is a cross-sectional view, taken along line 20D-20D in FIG. 19A.

FIGS. 19A, 19B, 20A, 20B, 20C, and 20D illustrate the female housing 203 and the male housing 205 being engaged, while the CPA device 8 is at a pre-lock position, and while the TPA device 206 (visible in FIG. 20A, for example), is at a full-lock position.

As shown in FIGS. 19A, 20A, and 20B, the protruding members 243 have entered the elongated slot 308 of the male housing 205.

As shown in FIG. 20B, wherein the CPA device is at a pre-lock position, the CPA device 8 has its wedge-like member 80 in a position adjacent to the interior bridge member 260. As depicted in FIG. 20B, the wedge-like member 80 is in a position corresponding to the first window 255 (shown in FIG. 14C) of the female housing 203.

FIG. 20B shows an engaging member 261 on an interior of the female housing 203. The cut-out portion 82 of the CPA device 8 engages with the engaging member 261 of the female housing 203, when the CPA device 8 is at a pre-lock position.

To signify completed entry of the wedge-like member 80 into the first window 255, a sound (preferably, a clicking sound or the like) may be heard.

Figure 22A:
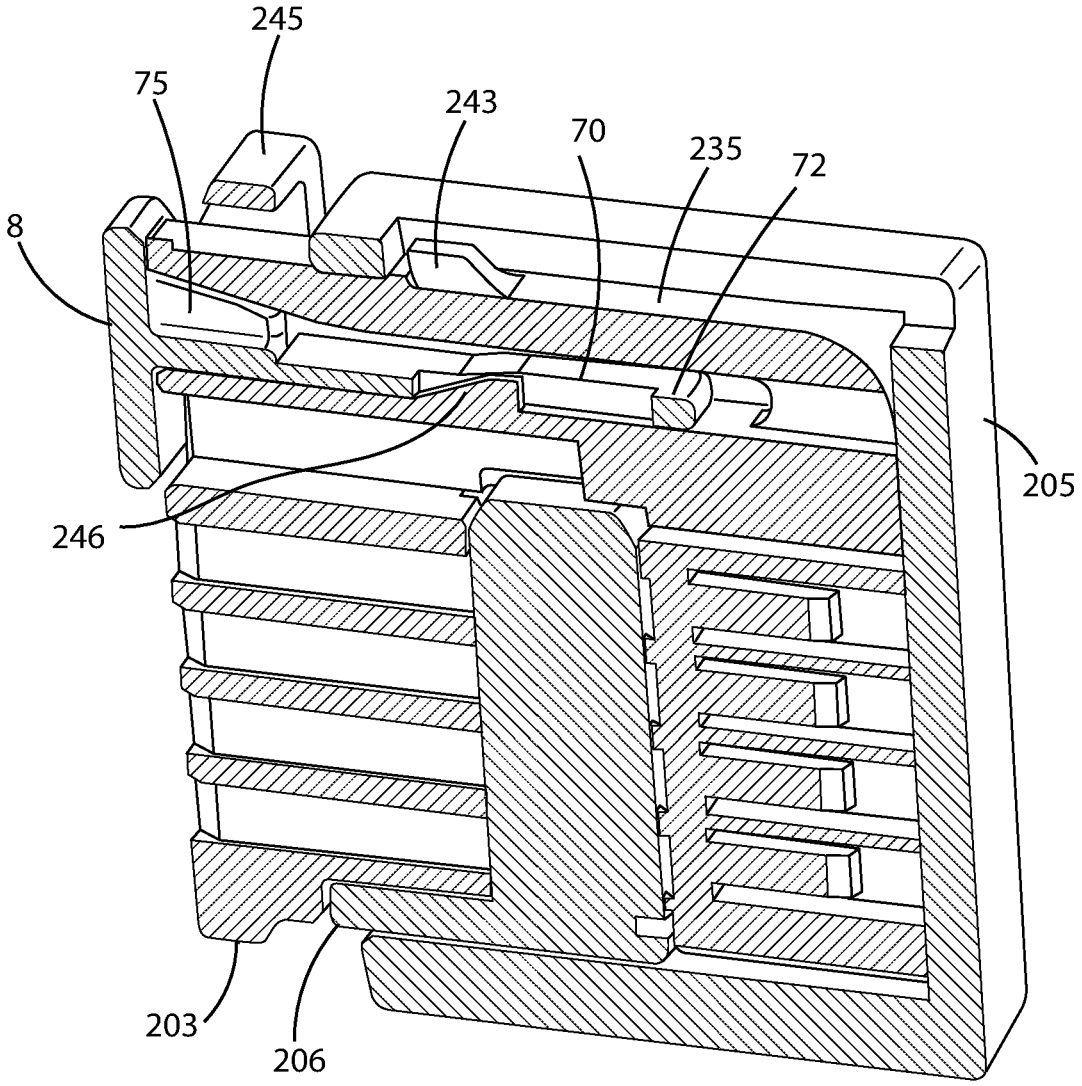
FIG. 22A is a cross-sectional view, taken along line 22A-22A in FIG. 21.
Figure 22B:
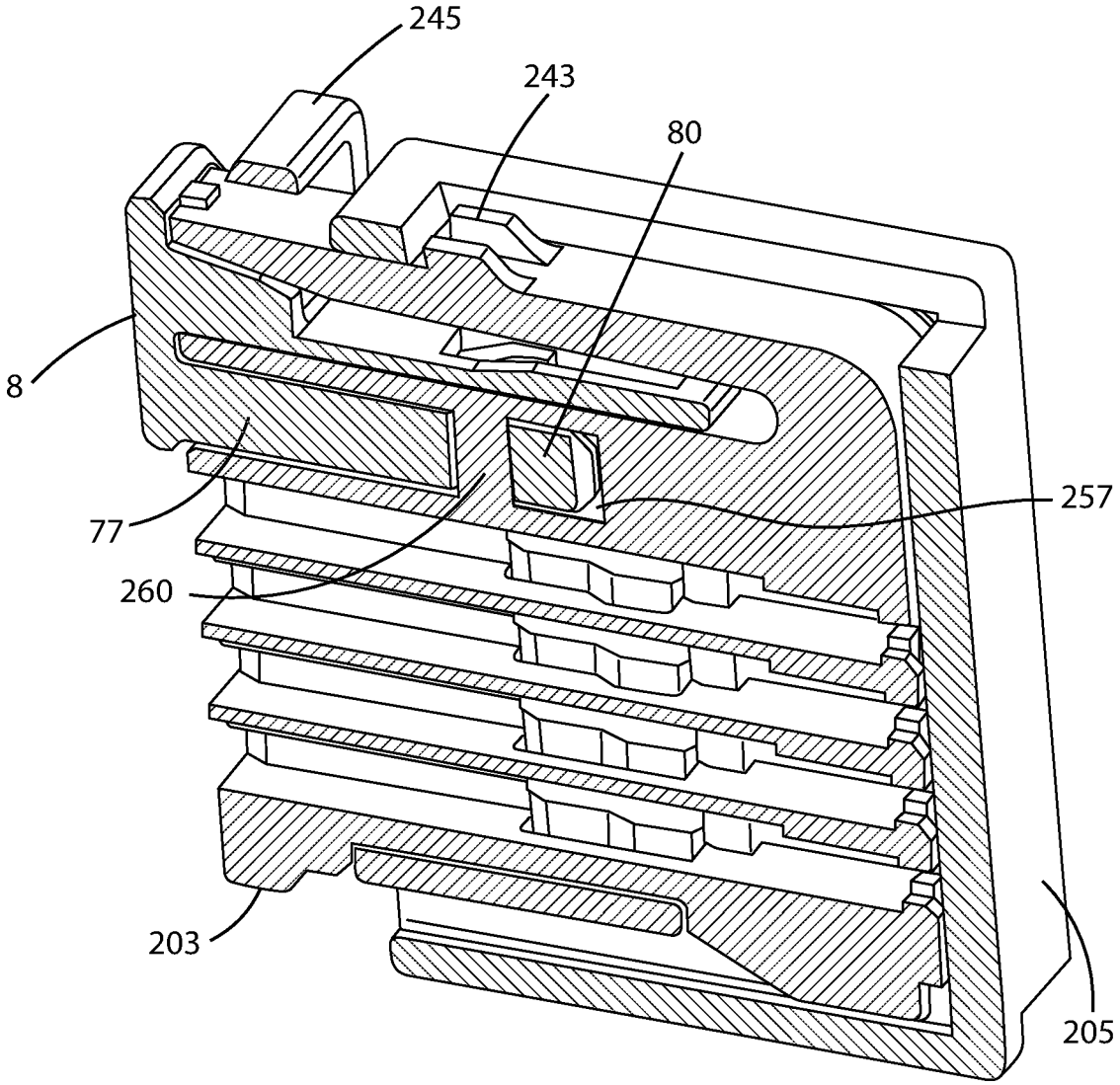
FIG. 22B is a cross-sectional view, taken along line 22B-22B in FIG. 21.
Figure 22C:
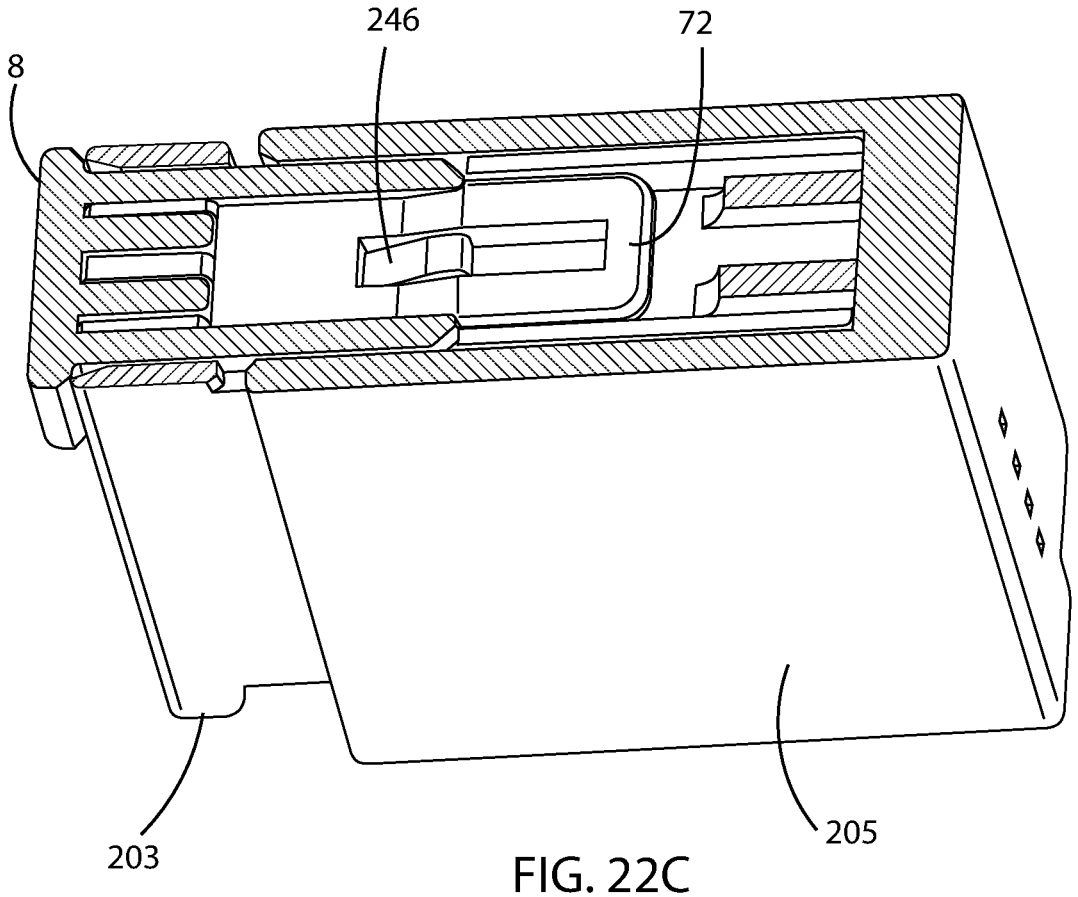
FIG. 22C is a cross-sectional view, taken along line 22C-22C in FIG. 21.
Figure 22D:
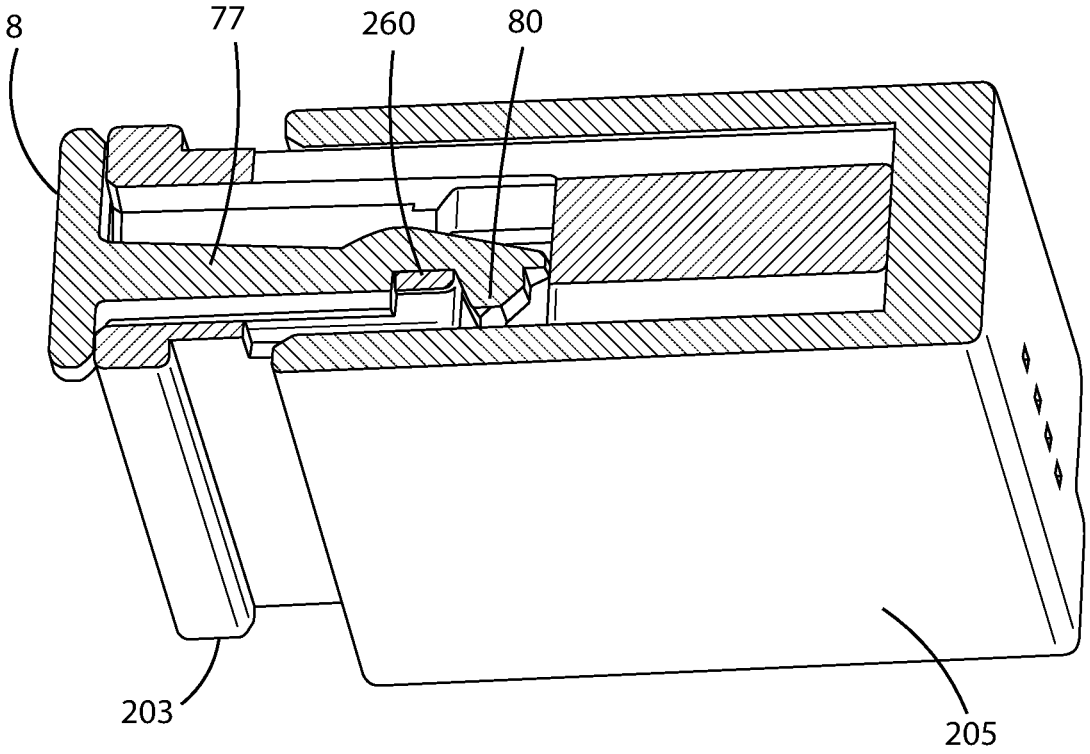
FIG. 22D is a cross-sectional view, taken along line 22D-22D in FIG. 21.

To facilitate the wedge-like member 80 first moving into the first window 255, second traversing the interior bridge member 260, and third moving into the second window 257, the front face of the wedge-like member 80 is preferably formed to have an inclined shape (see FIGS. 3A, 20D, and 22D, for example). The front face of the wedge-like member 80 is a face of the wedge-like member 80 disposed toward the front ledge 81.

The wedge-like member 80 is on the second flexible side member 77, which provides a spring-like action or resilience property.

At a pre-lock position, the side end portion 72 of the CPA device 8 has traversed the ramp-like member 246 of the female housing 203 and has passed beyond the end portion 250. When the side end portion 72 passes beyond the end portion 250, a sound (preferably a clicking sound or the like) may be heard. When the side end portion 72 passes beyond the end portion 250, the end portion 250 penetrates the opening 92.

At this time, the wedge-like member 80 is fitted inside the first window 255 and is in contact with the interior bridge member 260, and the wedge-like member 80 is held in place, at least partly, by the resiliency of the second flexible side member 77, and thus the CPA device 8 is prevented from easily moving further forward into the female housing 203. Also, at this time, the end portion 250 is penetrating the opening 92, and the side end portion 72 is held in place, at least partly, by the resiliency of the first flexible side member 70, and thus the CPA device 8 is prevented from easily moving backward out from the female housing 203.

Figure 21:
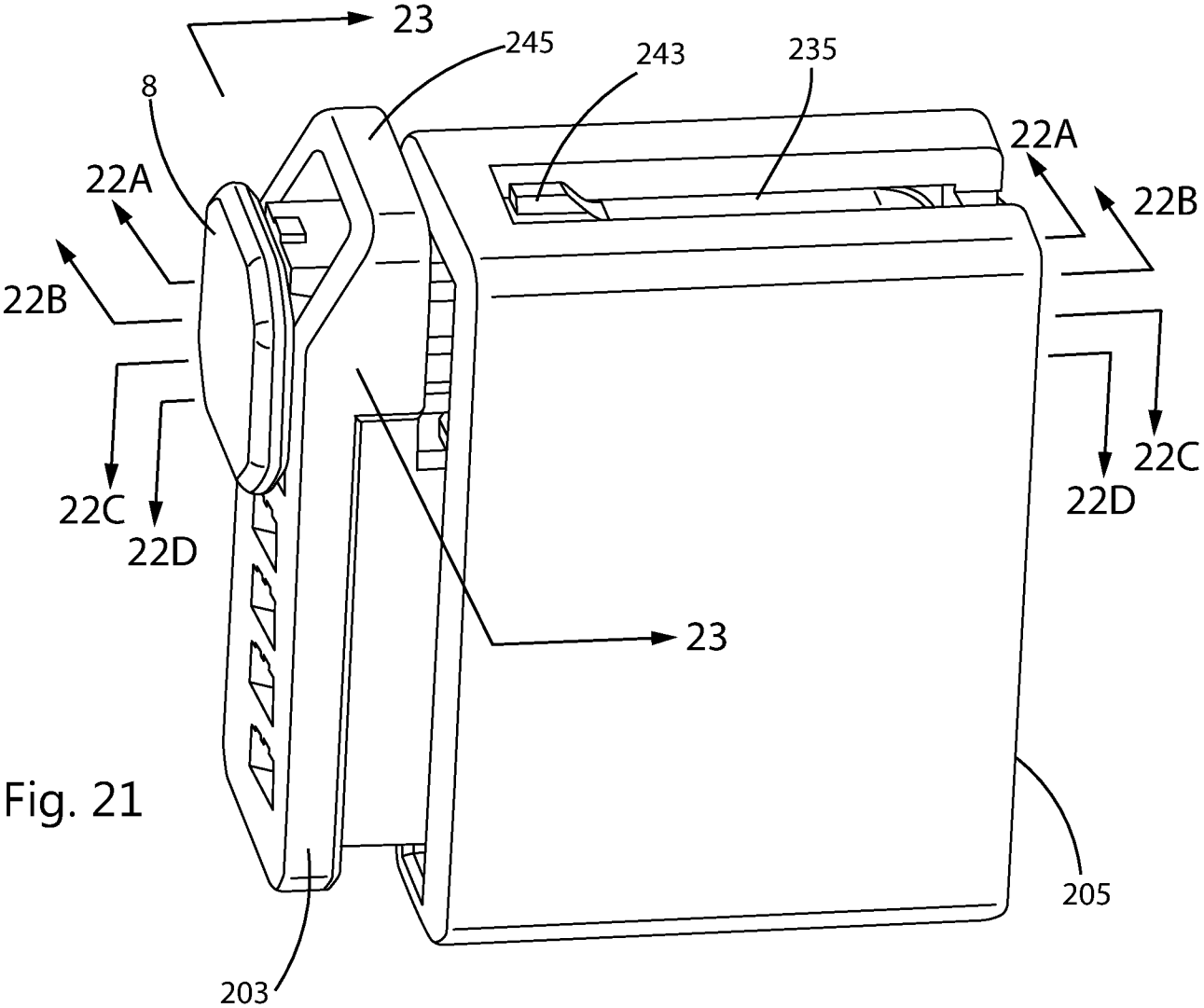
FIG. 21 is a perspective view of the female housing, male housing, and CPA device shown in FIG. 13, with the female housing coupled with the male housing, and with the CPA device inserted into the female housing at a full-lock position.

FIG. 21 is a perspective view of the female housing, male housing, and CPA device shown in FIG. 13, with the female housing coupled with the male housing, and with the CPA device inserted into the female housing at a full-lock position.

Figure 23:
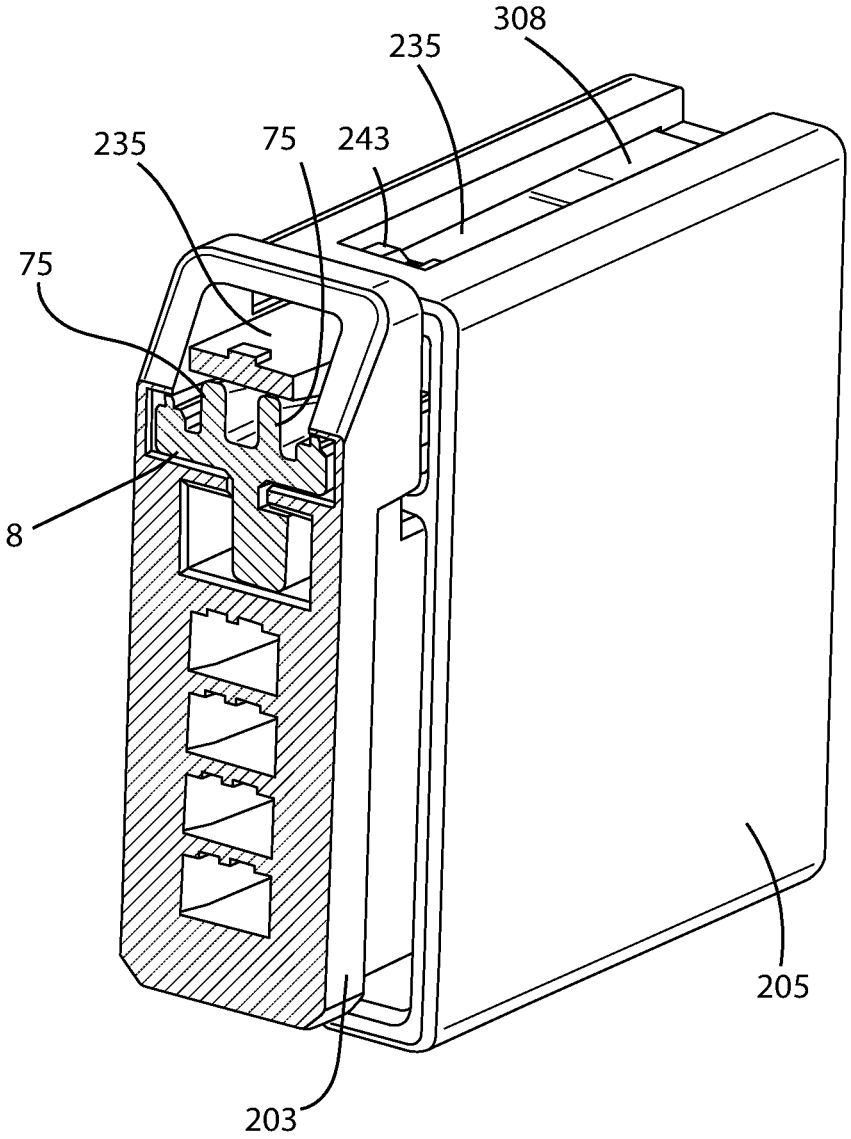
FIG. 23 is a cross-sectional view, taken along line 23-23 in FIG. 21.

FIG. 22A is a cross-sectional view, taken along line 22A-22A in FIG. 21. FIG. 22B is a cross-sectional view, taken along line 22B-22B in FIG. 21. FIG. 22C is a cross-sectional view, taken along line 22C-22C in FIG. 21. FIG. 22D is a cross-sectional view, taken along line 22D-22D in FIG. 21. FIG. 23 is a cross-sectional view, taken along line 23-23 in FIG. 21.

The manner in which the CPA device 8 is placed at a full-lock position with the female housing 203 shall now be described. When the CPA device 8 is at a full-lock position, this can provide assurance that the female housing 203 is fully and properly engaged, coupled, and locked with the male housing 205.

When the female housing 203 enters the opening 310 of the male housing 205, the protruding members 243 of the female housing 203 enter the elongated slot 308 of the male housing 205. When the CPA device 8 is at a pre-lock position, the flexible member 235 may be pushed downward toward an interior of female housing 203, permitting the protruding members 243 to go downward, which could facilitate the female housing 203 being pulled away from the male housing 205 if desired.

However, when the CPA device 8 is at a full-lock position, the side ledges 75 of the CPA device 8 will prevent the flexible member 235 of the female housing 203 from being pushed downward toward an interior of female housing 203, and thus the protruding members 243 cannot go downward. Thus, the female housing 203 cannot be pulled away from the male housing 205.

The CPA device 8 is moved to a full-lock position in the female housing 203 when the CPA device 8 is pushed deeper into the female housing 203, from a pre-lock position to a full-lock position. When the CPA device 8 moves from a pre-lock position to a full-lock position, the wedge-like member 80 of the CPA device 8 moves out from the first window 255, traverses the interior bridge member 260 between the first window 255 and the second window 257, and moves into the second window 257.

Upon entry of the wedge-like member 80 into the second window 257, a sound (preferably a clicking sound or the like) may be heard. When, or approximately when, the wedge-like member 80 enters the second window 257, the side end portion 72 of the first flexible side member 70 moves deeper into the female housing 203 while the end portion 250 is penetrating the opening 92. In addition, when the CPA device 8 is at a full-lock position, the side ledges 75 of the CPA device 8 are positioned beneath the flexible member 235, as shown in FIG. 23, and thus, the flexible member 235 cannot be pushed downward toward an interior of the female housing 203, and consequently, the protruding members 243 of the flexible member 235 cannot go downward to try to move out from the elongated slot 308 of the male housing 205. Thus, when the CPA device 8 is at a full-lock position, the female housing 203 cannot be pulled away from the male housing 205, and this serves to assure that the female housing 203 and the male housing 205, when engaged, remain fully locked together.

The female housing 203 forms terminal slots 233, terminal apertures 233, or terminal openings 233, intended to have therein electrically-conductive terminals, wires, or conductors. The male housing 205 forms terminal apertures 306, terminal slots 306, or terminal openings 306, intended to have installed therein electrically-conductive terminals, wires, or conductors. Thus, in view of the above, terminals or conductors of the female housing 203 can be electrically connected with terminals or conductors of the male housing 205.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

LIST OF REFERENCE NUMERALS

1 Connector system for 3-pin embodiment or 3-terminal embodiment
3 Female housing for 3-pin embodiment
5 Male housing for 3-pin embodiment
6 Terminal position assurance (TPA) device for female housing 3
8 Connector position assurance (CPA) device
13 Side slot on female housing 3
15 Top slot on female housing 3
18 Upper side of female housing 3
20 Lower side of female housing 3
22 First side of female housing 3
23 Protrusion on first side of female housing 3
24 Second side of female housing 3
26 Front end side of female housing 3
28 Back end side of female housing 3
30 Exterior bridge member on female housing 3
31 Groove on lower side of female housing 3
33 Terminal slots on back end side 28
34 Terminal slots on front end side 26
35 Flexible member or flexible arm on female housing 3
40 Front end of flexible member 35
42 Opening on front end side 26
43 Protruding members on flexible member 35
45 Substantially U-shaped member on female housing 3

46 Ramp-like member on female housing 3
50 End portion of ramp-like member 46
55 First window on lower side of female housing 3
57 Second window on lower side of female housing 3
60 Interior bridge member in female housing 3
61 Engaging member on interior of female housing 3
70 First flexible side member on CPA 8
71A First surface of first side 71B of first flexible side member 70
71B First side of first flexible side member 70
71C Second side 71B of first flexible side member 70
72 Side end portion of first flexible side member 70
73 Upper side of CPA 8
74 Lower side of CPA 8
75 Side ledges on CPA 8
77 Second flexible side member on CPA 8
80 Wedge-like member on lower side of second flexible side member 77
81 Front ledge on second flexible side member 77
82 Cut-out portion next to wedge-like member 80
83 Back ledge on second flexible side member 77
85 End portion of CPA 8
88 Ramp-like member on upper side of second flexible side member 77
90 End portion of ramp-like member 88
92 Opening or slot in first flexible side member 70
98 Top portion of TPA 6
100 First elongated member on TPA 6
102 Second elongated member on TPA 6
103 Space in male housing 5, for accommodating TPA 6
105 First end portion of male housing 5
106 Terminal apertures in male housing 5
107 Second end portion of male housing 5
108 Elongated slot on second side of male housing 5
109 First side of male housing 5
110 Opening in male housing 5
111 Second side of male housing 5
112 Guide groove in male housing 5
114 Guide protrusion in opening 110
200 Connector system for 4-pin embodiment or 4-terminal embodiment
203 Female housing for 4-pin embodiment
205 Male housing for 4-pin embodiment
206 Terminal position assurance (TPA) device for female housing 203
213 Side slot on female housing 203
215 Top slot on female housing 203
218 Upper side of female housing 203
220 Lower side of female housing 203
222 First side of female housing 203
223 Protrusion on first side of female housing 203
224 Second side of female housing 203
226 Front end side of female housing 203
228 Back end side of female housing 203
230 Exterior bridge member on female housing 203
231 Groove on lower side of female housing 203
232 Groove on upper side of female housing 203
233 Terminal slots on back end side 228
234 Terminal slots on front end side 226
235 Flexible member on female housing 203
240 Front end of flexible member 235
242 Opening on front end side 226
243 Protruding members on flexible member 235
245 Substantially U-shaped member on female housing 203
246 Ramp-like member on female housing 203
250 End portion of ramp-like member 246
255 First window on lower side of female housing 203
257 Second window on lower side of female housing 203
260 Interior bridge member in female housing 203
261 Engaging member on interior of female housing 203
298 Top portion of TPA 206
300 First elongated member on TPA 206
302 Second elongated member on TPA 206
303 Space in male housing 205, for accommodating TPA 206
305 First end portion of male housing 205
306 Terminal apertures in male housing 205
307 Second end portion of male housing 205
308 Elongated slot on second side of male housing 205
309 First side of male housing 205
310 Opening in male housing 205
311 Second side of male housing 205
312 Guide groove in male housing 205
314 First guide protrusion in opening 110
316 Second guide protrusion in opening 110

We claim:

1. A connector system, comprising:

a female housing forming at least a flexible arm, a first protrusion, and an aperture;

a connector position assurance device having at least a first flexible member, a second flexible member, and a first ledge, the first flexible member having a first side and a second side, the first ledge being on the first side, the second flexible member facing the second side, the first flexible member being received in the aperture of the female housing and engaging the first protrusion of the female housing at a pre-lock position, and the first ledge being received in the aperture of the female housing and engaging the flexible arm of the female housing at a full-lock position; and a male housing forming an aperture, the female housing being received in the aperture of the male housing and being coupled with the male housing at the full-lock position.

2. The connector system according to claim 1, wherein the female housing forms a window, and the second flexible member of the connector position assurance device penetrates the window at the pre-lock position.

3. The connector system according to claim 1, wherein a slot is penetrated by the first protrusion of the female housing at the pre-lock position.

4. The connector system according to claim 1, wherein the female housing forms an opening for receiving at least one electrically-conductive terminal, the male housing forms an opening for receiving at least one electrically-conductive terminal, and the terminals of female and male housings are connected electrically when at the full-lock position.

5. The connector system according to claim 1, wherein an audible sound is provided when the connector position assurance device moves to the pre-lock position.

6. The connector system according to claim 1, wherein the female housing forms a window, and the second flexible member of the connector position assurance device penetrates the window at the full-lock position.

7. The connector system according to claim 1, wherein the first protrusion of the female housing is a ramp-like member, and an audible sound is provided when the connector position assurance device moves to the full-lock position.

8. A method of operating a connector system, comprising:

inserting a first flexible member of a connector position assurance device and a second flexible member of the connector position assurance device a first distance into at least one aperture formed by a female housing, wherein the first flexible member has a first side and a second side, wherein a ledge is formed on the first side and the second flexible member faces the second side;

causing a protrusion formed by the female housing to penetrate an aperture formed in the first flexible member; and causing the second flexible member to penetrate a first window formed in the female housing, wherein the first distance corresponds to a pre-lock position, wherein the aperture formed in the first flexible member passes through the first flexible member.

9. The method of operating a connector system according to claim 8, further comprising:

inserting the female housing into an aperture formed by a male housing; and causing a protrusion formed on a flexible arm of the female housing to penetrate a slot formed by the male housing.

10. The method of operating a connector system according to claim 9, further comprising:

inserting the second flexible member of the connector position assurance device a second distance into the at least one aperture formed by the female housing; and causing the second flexible member to penetrate a second window formed in the female housing, wherein the second distance corresponds to a full-lock position.

11. The method of operating a connector system according to claim 9, further comprising:

inserting the second flexible member of the connector position assurance device a second distance into the at least one aperture formed by the female housing; and causing at least one ledge formed by the connector position assurance device to engage the flexible arm, wherein the second distance corresponds to a full-lock position.

12. The method of operating a connector system according to claim 9, further comprising:

electrically connecting at least one terminal of the female housing with at least one terminal of the male housing at the full-lock position, wherein the female housing forms an opening for receiving the at least one terminal of the female housing, and the male housing forms an opening for receiving the at least one terminal of the male housing.

13. The method of operating a connector system according to claim 12, wherein an audible sound is provided when the connector position assurance device moves to the full-lock position.

14. The method of operating a connector system according to claim 8, wherein an audible sound is provided when the connector position assurance device moves to the pre-lock position.

* * * * *